US006315387B1

(12) United States Patent
Horikoshi

(10) Patent No.: US 6,315,387 B1
(45) Date of Patent: Nov. 13, 2001

(54) PRINTING APPARATUS, CONTROL METHOD THEREFOR, AND COMPUTER-READABLE MEMORY

(75) Inventor: Hiroki Horikoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/349,114

(22) Filed: Jul. 8, 1999

(30) Foreign Application Priority Data

Jul. 10, 1998 (JP) ..... 10-196334
Jun. 8, 1999 (JP) ..... 11-161617

(51) Int. Cl.[7] ..... B41J 2/145
(52) U.S. Cl. ..... 347/40; 347/15; 347/43
(58) Field of Search ..... 347/40, 41, 43, 347/12, 15, 10, 56, 65, 47

(56) References Cited

U.S. PATENT DOCUMENTS

| | | | |
|---|---|---|---|
| 4,313,124 | 1/1982 | Hara | 347/56 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/10 |
| 4,740,796 | 4/1988 | Endo et al. | 347/56 |

FOREIGN PATENT DOCUMENTS

| | | |
|---|---|---|
| 54-56847 | 5/1979 | (JP) . |
| 59-123670 | 7/1984 | (JP) . |
| 59-138461 | 8/1984 | (JP) . |
| 60-71260 | 4/1985 | (JP) . |

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

A printing apparatus acquires image characteristic information about the image characteristics of input image information. The printer apparatus includes a first printhead having ink orifices which are arranged in the printing medium convey direction and correspond to the types of inks used for printing, and a second printhead having ink orifices which are laid out symmetrically to the ink orifices of the first printhead. A multipath/double-head data generator distributes print dots based on the input image information to first and second print dots on the basis of the image characteristic information. A first printhead controller controls multipath printing of the first printhead in accordance with the first print dots. A second printhead controller controls multipath printing of the second printhead in accordance with the second print dots.

31 Claims, 18 Drawing Sheets

PRINTING APPARATUS, CONTROL METHOD THEREFOR, AND COMPUTER-READABLE MEMORY

BACKGROUND OF THE INVENTION

1. Field of the Invention

The present invention relates to a printing apparatus for forming an image by discharging ink to a printing medium on the basis of input image information, a control method therefor, and a computer-readable memory.

2. Description of the Related Art

In resent years, OA devices such as personal computers, copying machines, and wordprocessors have become popular. As a kind of printing eapparatuse for these devices, inkjet printing apparatuses for printing an image by an inkjet printing method are rapidly developed and spread. With advanced functions of OA devices, color images are required, and various color inkjet printing apparatuses are being developed.

In general, the inkjet printing apparatus comprises a printing means (printhead), a carriage for mounting an ink tank, a convey means for conveying a printing sheet, and a control means for controlling them. A printhead for discharging ink droplets from a plurality of orifices serial-scans in a direction (to be referred to as a main scanning direction) perpendicular to the convey direction (to be referred to as a subscanning direction) of a printing sheet. In non-printing, a printing sheet is intermittently conveyed by an amount equal to a printing width. A color inkjet printing apparatus forms a color image by overlapping ink droplets discharged from printheads of a plurality of colors on a printing medium.

Examples of the method of printing an image by discharging ink in the inkjet printing apparatus area method using an electrothermal energy converter in which a heating element (electrothermal energy converter) is disposed near an orifice and an electrical signal is applied to the heating element to locally heat ink and change the pressure, thereby discharging ink from the orifice, and a method using an electromechanical converter such as a piezoelectric element. A known example of the means of discharging ink is an arrangement using an electro-pressure conversion means, such as a piezoelectric element, to apply a mechanical pressure to ink, thereby discharging the ink.

These methods print characters and figures by discharging small ink droplets from an orifice onto a printing medium in accordance with print data. The inkjet printing apparatus hardly generates noise because of a non-impact type, can reduce the running cost and apparatus size, and can relatively easily print a color image. With these advantages, the inkjet printing apparatus is employed in a computer, wordprocessor, and the like. Further, the inkjet printing apparatus is widely used as a printing apparatus mounted on a stand-alone copying machine, printer, facsimile, and the like.

In the printing method of the conventional inkjet printing apparatus, a dedicated coated sheet having an ink absorption layer must be used to obtain a high-development color image free from any ink blur on a printing medium. Recent improvements of ink and the like allow practically using a method having printability on plain sheets which are enormously consumed in a printer, copying machine, and the like. In addition, demands arise to cope with various printing media having different ink absorption characteristics, such as an OHP sheet, cloth, and plastic sheet. To meet these demands, printing apparatuses capable of performing best printing regardless of the type of printing medium are being developed and put into practical use. As for the size of a printing medium, demands arise for printing on a large-size printing medium such as printing on an advertising poster, cloth such as clothes, and the like. Such inkjet printing apparatus is being demanded as an excellent printing means in various industrial fields. Higher image qualities and higher speeds are also being required.

In general, the printing method of the color inkjet printing apparatus realizes color printing using three, cyan (Cy), magenta (Mg), and yellow (Ye) color inks or four color inks including a black (Bk) ink. This color inkjet printing apparatus prints a color image, unlike a monochrome inkjet printing apparatus mainly used to print characters, and is required for various factors such as the color development, gradation, and uniformity of an image to be printed.

However, the quality of an image to be printed greatly depends on the performance of the printhead itself. That is, slight differences between orifices caused in manufacturing the printhead, such as variations in shapes of the orifices of the printhead or electrothermal converters (discharge heaters), influence the discharge amount and direction of discharged ink, resulting in low image quality as density nonuniformity of a final printed image. Consequently, a "blank" portion which inhibits an area factor of 100% periodically appears in the main scanning direction, dots excessively overlap each other, or a blank stripe appears on a printing medium. These phenomena are sensed as density nonuniformity by a human eye.

To prevent this density nonuniformity, a multipath printing methodisproposed. This multipathprinting method will be described with reference to FIG. 17.

In FIG. 17, a multipath printing method using a printhead of a single ink color having eight nozzles (orifices) will be exemplified for descriptive convenience.

FIG. 17 is a view for explaining the conventional multipath printing method.

In the first scanning of the printhead in the main scanning direction, a staggered pattern ● is printed using first four nozzles out of the eight nozzles of the printhead. The printing sheet is fed in the subscanning direction by half the printing width of the printhead (by a width of 4 dots in this case). Then, in the second scanning of the printhead, an inverted staggered pattern ○ is printed using all the eight nozzles of the printhead to complete printing in a printing area corresponding to half the printing width of the printhead. That is, a 4-dot wide printing area is completed every scanning by sequentially feeding the printing sheet in units of 4 dots and alternately printing staggered and inverted staggered patterns. In this way, one line (printing area by one scanning with the printing width of the printhead) is printed using two different nozzles, thereby forming a high-quality image almost free from density nonuniformity. Also, the multipath printing method can perform printing while drying ink.

Known examples of a method of generating data (path data) not to be printed (not to discharge ink) in each scanning are a method (fixed thinning method) of generating path data by thinning out print data using a staggered/inverted staggered pattern, as described above, a method (random thinning method) of generating path data by thinning out print data using a random mask pattern prepared by laying out print dots and non-print dots at random, and a method (data thinning method) of generating path data by thinning out print dots.

To form an image of a color other than three, cyan (Cy), magenta (Mg), and yellow (Ye) color inks or four color inks including a black (Bk) ink on a printing medium, ink droplets of a plurality of colors are landed on the same position to mix the colors on the printing medium. An example of printing green (G) with a printhead constituted to perform printing on a printing medium in the order of Bk, Cy, Mg, and Ye in forward-path scanning and in the order of Ye, Mg, Cy, and Bk in return-path scanning will be explained with reference to FIG. 18.

FIG. 18 is a view for explaining a conventional dot landing surface of two colors.

As shown in FIG. 18, when another dot overlaps a previously printed dot in inkjet printing, the subsequent dot tends to sink in a sheet surface deeper than the previous dot at the overlapping portion.

To print green (G), Cy and Ye inks are sequentially landed on a printing medium in forward-path scanning by the carriage. At this time, the Cy ink permeates into the printing medium and spreads on the surface and internally. The Ye ink landed next gets under the Cy ink. When viewed from the printing medium surface, the Ye ink seems to spread around the Cy ink. The mixed portion of Cy and Ye becomes G, and is recognized by a human eye as if G were printed. To the contrary, in return-path scanning, the Ye and Cy inks are sequentially landed. The Cy ink gets under the Ye ink, and the mixed portion of Ye and Cy becomes G' which contains Ye more dominantly than Ye. That is, the preferential color changes depending on the landing order of two types of inks (Cy and Ye in this case). On the forward path, previously absorbed Cy is a preferential color to obtain Cy-rich G. On the return path, Ye-rich G' is obtained.

For this reason, in reciprocal printing, even color mixing of the same Cy and Ye inks changes the tint between mixed colors by forward-path printing and return-path printing. As a result, two different colors are expressed on a printing medium with respect to human visual properties, and mixed colors having different tints are recognized every scanning.

To solve this problem, there is proposed a color inkjet printing apparatus having two independent printheads for forward-path printing and return-path printing, thereby realizing high-quality reciprocal printing free from any tint difference. In this color inkjet printing apparatus, a printhead for forward-path printing and a printhead for return-path printing have symmetrical (opposite) printhead layouts of cyan (Cy), magenta (Mg), yellow (Ye), and black (Bk) colors, and thus have a common landing order of the respective inks to a printing medium to eliminate the tint difference between mixed colors by forward-path printing and return-path printing.

However, in the printing apparatus constituted to eliminate the tint difference between mixed colors by forward-path printing and return-path printing, the forward-path printhead performs printing operation on only the forward path and lies idle on the return path. Similarly, the return-path printhead lies idle on the forward path and performs printing operation on only the return path. That is, although the printing apparatus comprises the two printheads, one printhead performs only one-way printing, which poses the following problem.

While the printhead lies idle in non-printing scanning, it must form an image at a high duty in printing scanning. This prevents an increase in carriage speed or causes a discharge error owing to the temperature rise of the printhead. In terms of forming a high-quality image, the two printheads are not effectively used.

SUMMARY OF THE INVENTION

The present invention has been made to solve the above drawbacks, and has as its object to provide a printing apparatus for realizing high-quality printing at a high speed without causing any tint difference by reciprocal printing, a control method therefor, and a computer-readable memory.

To achieve the above object, a printing apparatus according to the printing apparatus comprises the following arrangement.

That is, a printing apparatus for forming an image by discharging ink to a printing medium on the basis of input image information comprises acquisition means for acquiring image characteristic information about an image characteristic of the input image information, a first printhead having ink orifices which are arranged in a printing medium convey direction and correspond to the types of inks used for printing, a second printhead having ink orifices which are laid out symmetrically to the ink orifices of the first printhead, distribution means for distributing print dots based on the input image information to first and second print dots on the basis of the image characteristic information, first control means for controlling multipath printing of the first printhead in accordance with the first print dots, and second control means for controlling multipath printing of the second printhead in accordance with the second print dots.

To achieve the above object, a printing apparatus control method according to the printing apparatus comprises the following steps.

That is, a control method for a printing apparatus for forming an image by discharging ink to a printing medium on the basis of input image information, comprising the acquisition step of acquiring image characteristic information about an image characteristic of the input image information, the distribution step of distributing print dots based on the input image information to first and second print dots on the basis of the image characteristic information, the first control step of controlling, in accordance with the first print dots, multipath printing of a first printhead having ink orifices which are arranged in a printing medium convey direction and correspond to the types of inks used for printing, and the second control step of controlling, in accordance with the second print dots, multipath printing of a second printhead having ink orifices which are laid out symmetrically to the ink orifices of the first printhead.

To achieve the above object, a computer-readable memory according to the printing apparatus comprises the following program codes.

That is, a computer-readable memory storing control program codes for a printing apparatus for forming an image by discharging ink to a printing medium on the basis of input image information comprises a program code of the acquisition step of acquiring image characteristic information about an image characteristic of the input image information, a program code of the distribution step of distributing print dots based on the input image information to first and second print dots on the basis of the image characteristic information, a program code of the first control step of controlling, in accordance with the first print dots, multipath printing of a first printhead having ink orifices which are arranged in a printing medium convey direction and correspond to the types of inks used for printing, and a program code of the second control step of controlling, in accordance with the second print dots, multipath printing of a second printhead having ink orifices which are laid out symmetrically to the ink orifices of the first printhead.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described in detail below with reference to the accompanying drawings.

First Embodiment

Figure 1:
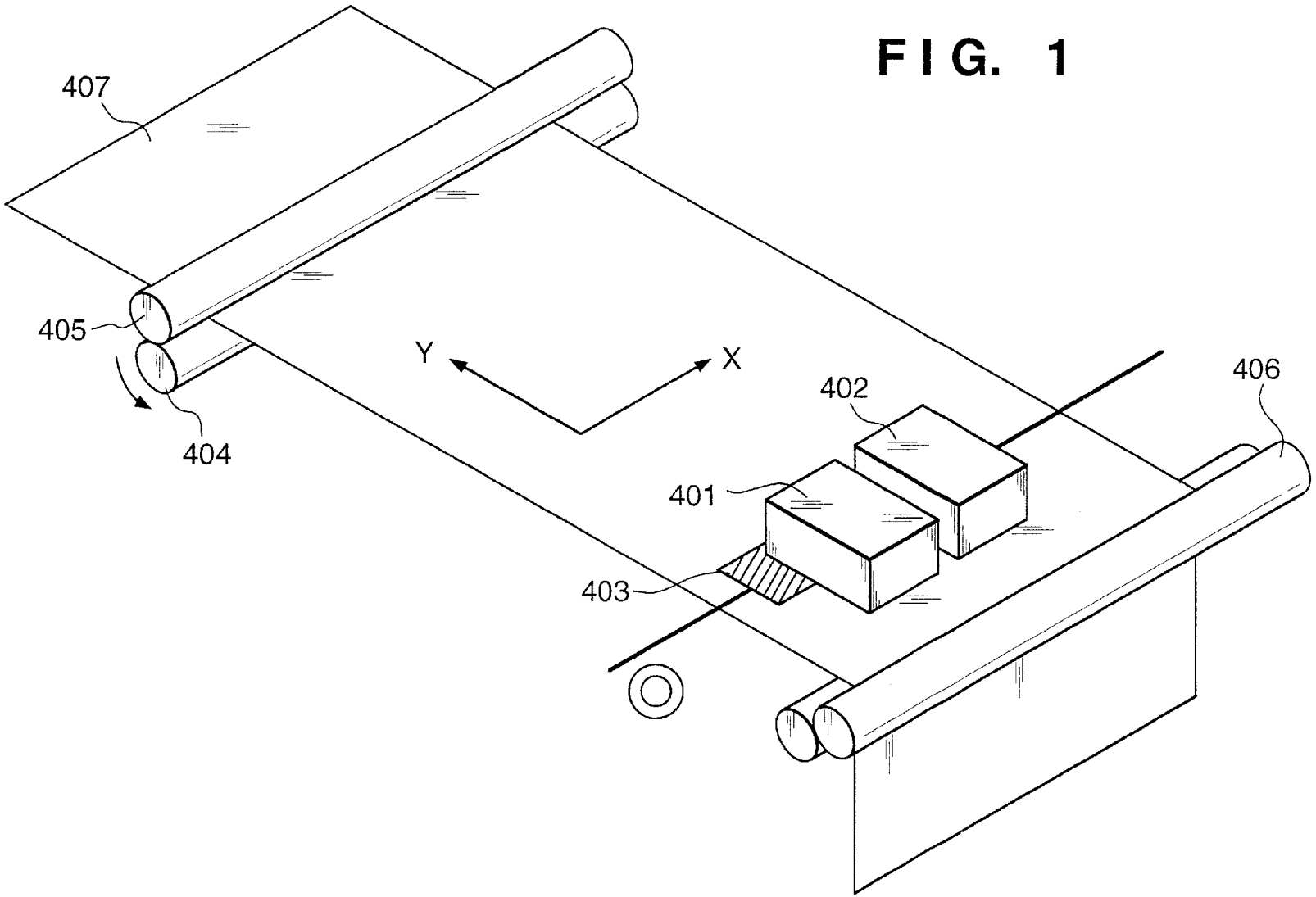
FIG. 1 is a perspective view showing the arrangement of the printing unit of an inkjet printing apparatus according to the present invention.

FIG. 1 is a perspective view showing the arrangement of the printing unit of an inkjet printing apparatus according to the present invention.

Reference numeral 401 denotes a first printhead constituted by a multi-printhead obtained by integrating ink tanks respectively storing color inks of four colors (Bk, Cy, Mg, and Ye) and four corresponding printheads; and 402, a second printhead with the same arrangement as the first printhead 401 in which the layout of printheads for discharging inks of the four colors (Ye, Mg, Cy, and Bk) is symmetrical to the layout of the printhead 401.

Reference numeral 403 denotes a carriage which supports the first and second printheads 401 and 402 and moves them along with printing. The carriage 403 is at a home position ⓒ in FIG. 1 in a standby state such as a non-printing state. Reference numeral 404 denotes a paper feed roller which rotates in the arrow direction in FIG. 1 to feed a printing sheet 407 in the Y direction while suppressing the printing sheet 407 together with an auxiliary roller 405; and 406, paper feed rollers which feed the printing sheet 407 while suppressing the printing sheet 407 similarly to the paper feed roller 404 and auxiliary roller 405. The first printhead 401 has 64 nozzles arranged in the paper feed direction for the four, Bk, Cy, Mg, and Ye colors.

Basic reciprocal printing operation in this arrangement will be described.

While the carriage 403, which is at the home position ⓒ on standby, scans in the X direction upon reception of a printing start command, the first and second printheads 401 and 402 discharge ink from a plurality of nozzles onto the printing sheet 407 in accordance with print data to print the print data. When the print data are printed up to the right end of the printing sheet 407, the carriage 403 returns to the original home position ⓒ. The paper feed roller 404 rotates in the arrow direction to feed the sheet in the Y direction by a predetermined width, and printing starts in the X direction again. These scanning operation and paper feed operation are repeated to print print data.

Although not shown, the inkjet printing apparatus of the first embodiment comprises a controller made up of a CPU, ROM, RAM, and dedicated circuit for controlling and executing printing and image processing, an interface for exchanging image information and various control information with an external host computer and the like, a motor driver for driving a carriage driver for driving the carriage, a paper feed motor for driving the paper feed motor, a paper convey motor for conveying a paper sheet, and the like, a printhead driver for driving the first and second printheads 401 and 402, an operation panel for allowing the user to input control information, and the like.

Figure 2:
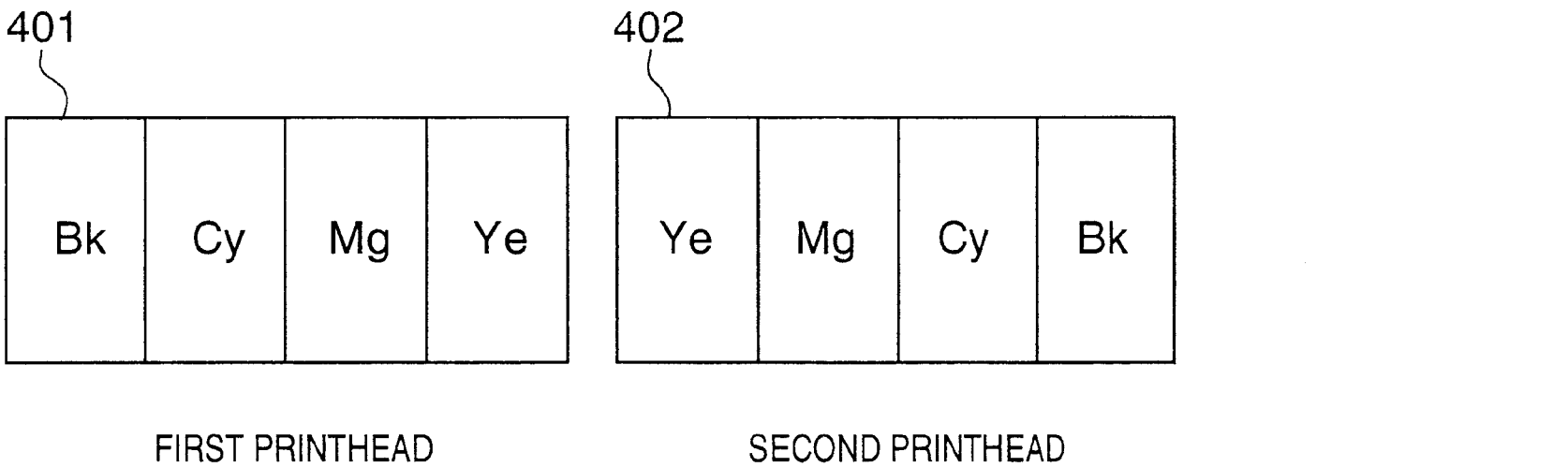
FIG. 2 is a view showing the layout of the nozzles of first and second printheads according to the first embodiment of the present invention.

The first printhead 401 is disposed on the front side in the forward-path scanning direction, and nozzles for discharging inks of the respective colors are laid out in the order of Bk, Cy, Mg, and Ye. The second printhead 402 is disposed on the rear side, and nozzles for discharging inks of the respective colors are laid out in the order of Ye, Mg, Cy, and Bk symmetrically to the first printhead 401. This layout is shown in FIG. 2.

A printhead control block for controlling printing operation of the first and second printheads 401 and 402 will be explained with reference to FIG. 3.

Figure 3:
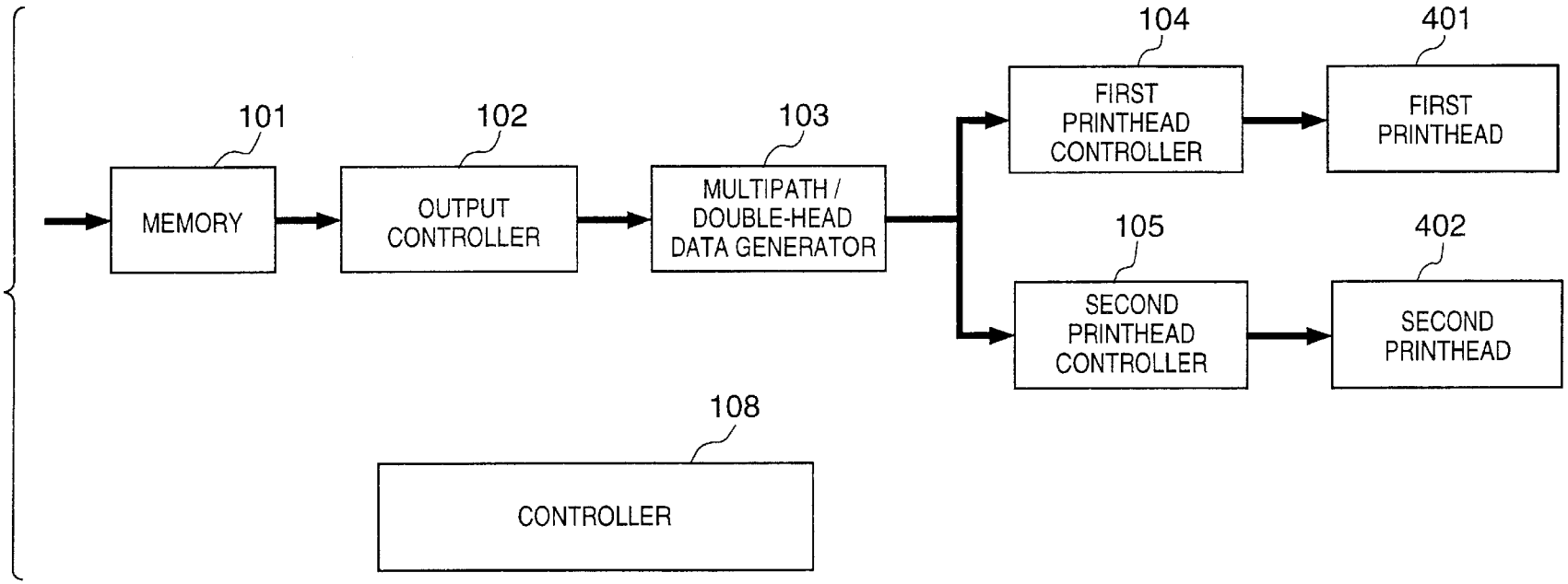
FIG. 3 is a block diagram showing the arrangement of a printhead control block according to the first embodiment of the present invention.

FIG. 3 is a block diagram showing the printhead control block according to the first embodiment of the present invention.

The inkjet printing apparatus in the first embodiment adopts a multipath printing method of performing reciprocal printing by distributing print dots to the first and second printheads 401 and 402, and in addition forming an image by scanning the same area a plurality of number of times. As described above, the multipath printing is a printing method of forming a 1-line image using a plurality of nozzles to suppress density nonuniformity caused by a slight difference in ink discharge amount or discharge direction between nozzles. The first embodiment executes, among multipath printing methods, a fixed thinning method of generating path data in accordance with the coordinate in the main scanning direction, and a data thinning method of generating path data by thinning out print dots. The number of printing paths is selectively two or four.

Reference numeral 101 denotes a memory which temporarily stores print data having undergone image processing for printing, and stores a path count flag (e.g., 0 for 2-path printing and 1 for 4-path printing) for analyzing image characteristics (image area, text area, and the like) of print data within one page and determining the number of printing paths of each scanning printing area within one page in accordance with the analysis result.

Reference numeral 102 denotes an output controller for reading out print data on the basis of a relative position on a printing medium for each ink in the printhead; 103, a multipath/double-head data generator for thinning out print dots in accordance with the number of printing paths to generate first printhead path data and second printhead path data; 104, a first printhead controller for generating various control signals for driving the first printhead 401; and 105, a second printhead controller for generating various control signals for driving the second printhead 402. The first printhead 401 discharges ink onto a printing medium in accordance with first printhead path data, and the second printhead 402 discharges ink onto a printing medium in accordance with second printhead path data. Reference numeral 108 denotes a controller for monitoring the state of each unit and performing various control operations about printhead driving in accordance with a path count flag.

Basic printhead control operation of the whole printhead control block will be explained.

The memory 101 temporarily stores print data binarized by a binarization means (not shown) in units of ink colors. The output controller 102 reads out binary print data stored in the memory 101 every scanning in accordance with the relative positions of nozzles corresponding to respective ink colors, and outputs the readout data to the multipath/double-head data generator 103. Data of 64 pixels corresponding to the number of nozzles are transferred to the multipath/double-head data generator 103 in units of respective color inks by one data transfer. The multipath/double-head data generator 103 generates first printhead path data for the first printhead 401 and second printhead path data for the second printhead 402 by the fixed thinning method and data thinning method in accordance with the number of printing paths, and outputs the generated data to the first and second printhead controllers 104 and 105. A method of generating path data for each printhead will be described in detail below.

The first printhead controller 104 generates a control signal to drive the first printhead 401 in accordance with positional information based on a linear encoder (not shown) and various parameters and commands from the controller 108. Similarly, the second printhead controller 105 generates a control signal to drive the second printhead 402 in accordance with positional information based on the linear encoder and various parameters and commands from the controller 108.

Generation of first printhead path data and second printhead path data will be explained in detail.

As described above, the inkjet printing apparatus in the first embodiment performs multipath printing of generating path data for each printhead by the fixed thinning method and data thinning method, and appropriately selects between 2-path printing and 4-path printing in accordance with the above-mentioned path count flag to form an image. Print dots for each path are distributed to the first and second printheads 401 and 402. Distribution of print dots for each path in 4-path printing will be explained with reference to FIG. 4.

Figure 4:
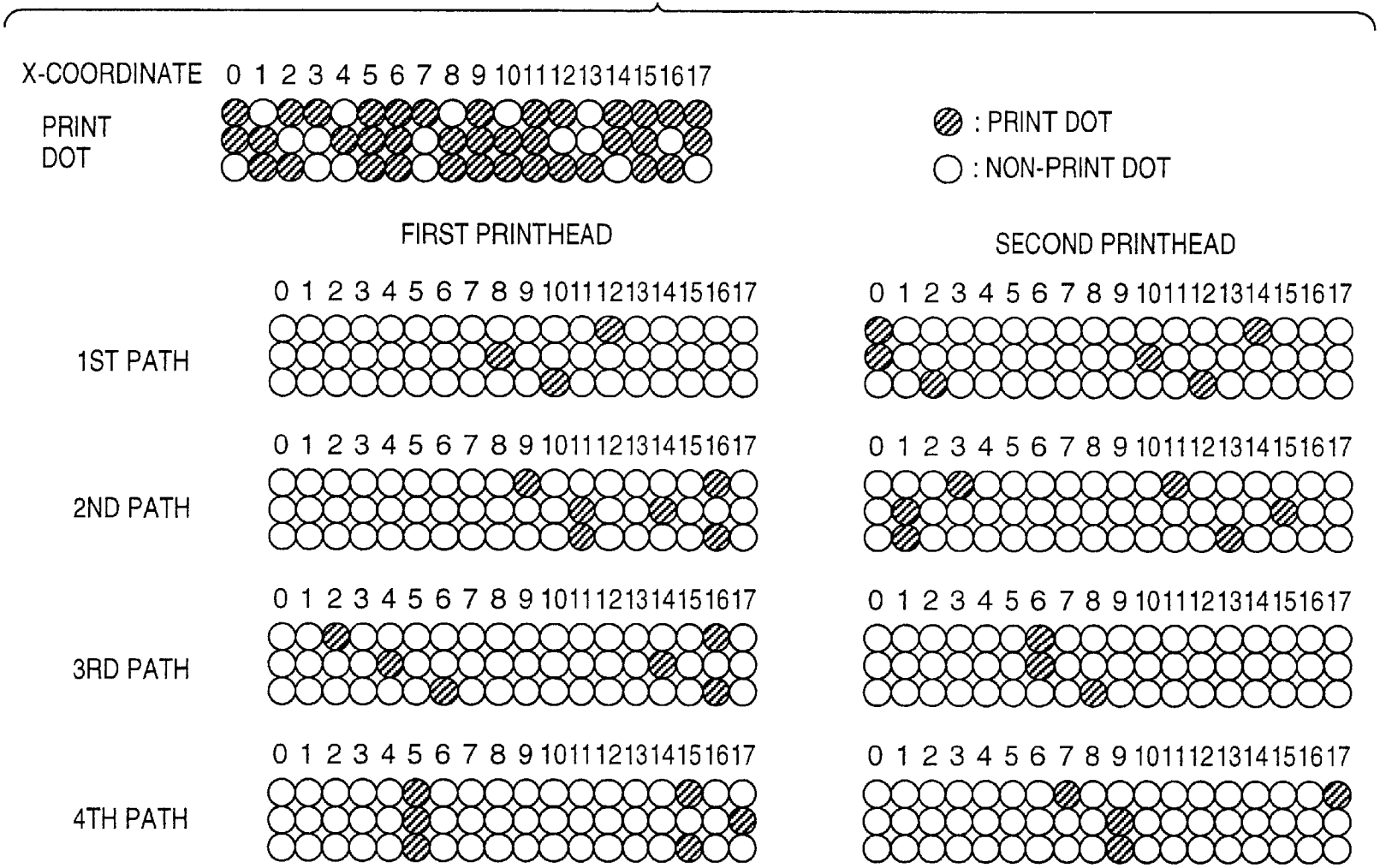
FIG. 4 is a view showing distribution of print dots for each path in 4-path printing according to the first embodiment of the present invention.

FIG. 4 is a view showing distribution of print dots for each path in 4-path printing according to the first embodiment of the present invention.

Fixed thinning (fixed mask) processing by the fixed thinning method will be described.

In the first embodiment, even-numbered dots (even dots) in the main scanning direction are printed on an even-numbered path (scanning for an even path number), and odd-numbered dots (odd dots) in the main scanning direction are printed on an odd-numbered path (scanning for an odd path number). The path number is a 2-bit number assigned to each scanning, and repeats 0 and 1 in 2-path printing and 0, 1, 2, and 3 in 4-pathprinting. Maskprocessing (non-print dots replace print dots) is done for odd dots on an even path and for even dots on an odd path in accordance with the lower bit of the path number. Data thinning (data mask) processing by the data thinning method will be described.

In the first embodiment, print dots are thinned out for fixedly thinned data for each path in accordance with the lower bit of the path number, and data of each path is generated in accordance with the number of printing paths, a path number (upper bit), and a printhead number. More specifically, for example, 2-bit print dot counters corresponding to the 64 nozzles are provided to count the number of print dots on each path for the nozzles. Data of each path for the first and second printheads 401 and 402 are generated in accordance with a counter value, the number of printing paths, and a path number. That is, in 4-path printing, only print dots at which the upper bit of the path number coincides with the upper bit of the counter are printed, whereas the remaining print dots are masked. In 2-path printing, the upper bit of the path number is insignificant, and no mask processing is performed. The lower bit (corresponding to the printhead number) of the counter is used for distribution to the first and second printheads 401 and 402. A print dot having a lower bit of 0 is distributed to the first printhead 401, and a print dot having a lower bit of 1 is distributed to the second printhead 402.

Note that the 64 nozzles are assigned with nozzle numbers #0 to #63.

First printhead path data generation processing (mask processing) of each color (e.g., Cy) in the first printhead 401 for data corresponding to the number of nozzles (64) on each path will be explained with reference to FIGS. 5 and 6.

Figure 5:
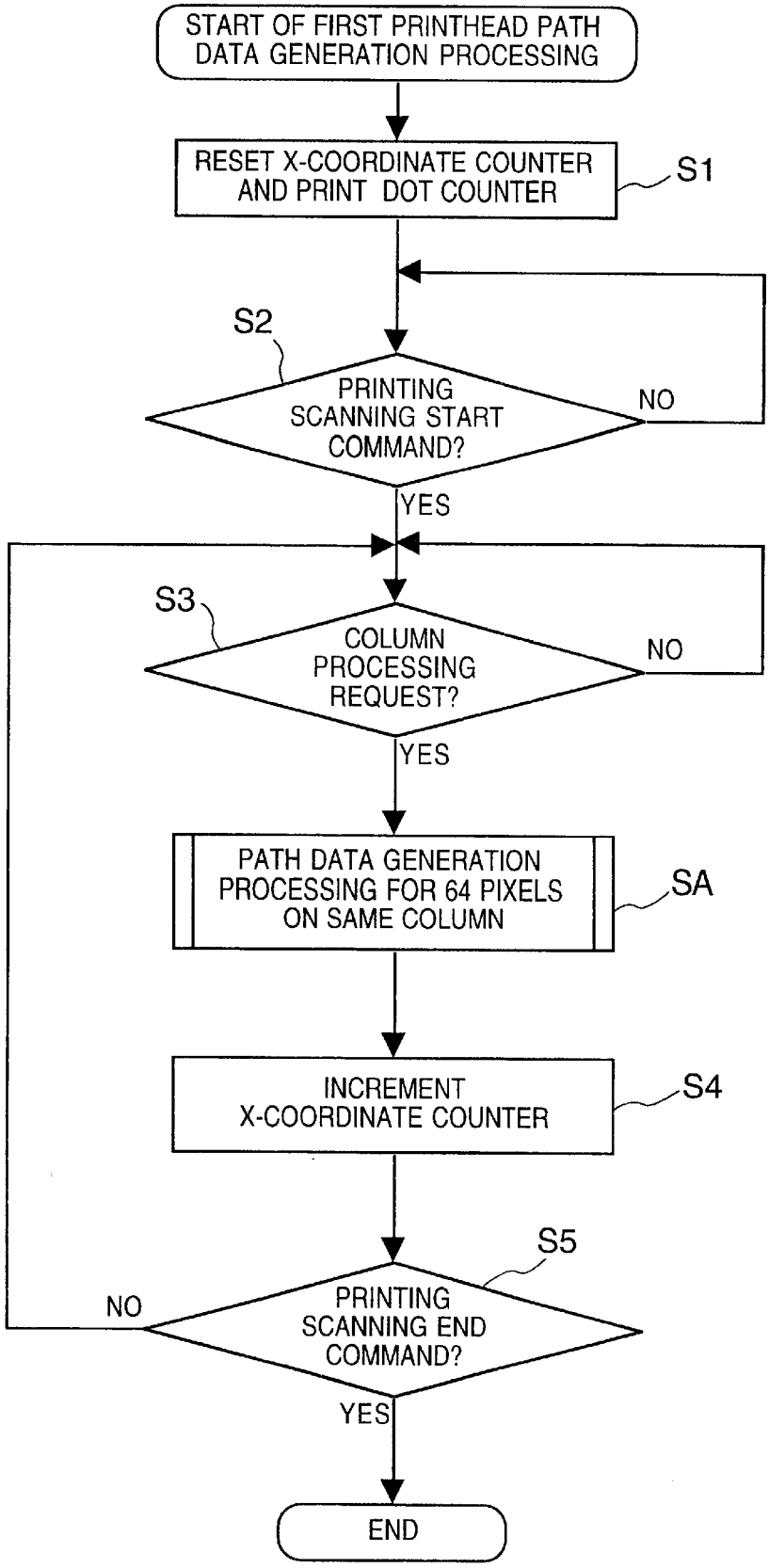
FIG. 5 is a flow chart showing first printhead path data generation processing of each color in the first printhead according to the first embodiment of the present invention.

FIG. 5 is a flow chart showing first printhead path data generation processing of each color in the first printhead according to the first embodiment of the present invention.

At the start of scanning, an X-coordinate counter (1 bit) indicating whether a column to be processed is an even- or odd-numbered one, and the 64 print dot counters #0 to #63 (each made up of 2 bits) are reset (step S1). A printing start command from the controller 108 is checked (step S2). If no printing start command exists (NO in step S2), the flow waits until a printing start command is detected. If a printing start command exists (YES in step S2), a column processing request according to a linear encoder output is checked in response to the printing start command (step S3). If no column processing request exists (NO in step S3), the flow waits until a column processing request is detected. If a column processing request exists (YES in step S3), path data generation processing for 64 pixels in the Y direction is executed (step SA). The path data generation processing will be described in detail below.

Upon completion of path data generation processing, the X-coordinate counter is incremented (step S4). A printing end command is checked (step S5). If no printing end command exists (NO in step S5), the flow returns to step S3 to wait until a column processing request according to a linear encoder output is detected again. If a printing end command exists (YES in step S5), printing scanning ends in response to this.

Path data generation processing in step SA will be explained in detail with reference to FIG. 6.

Figure 6:
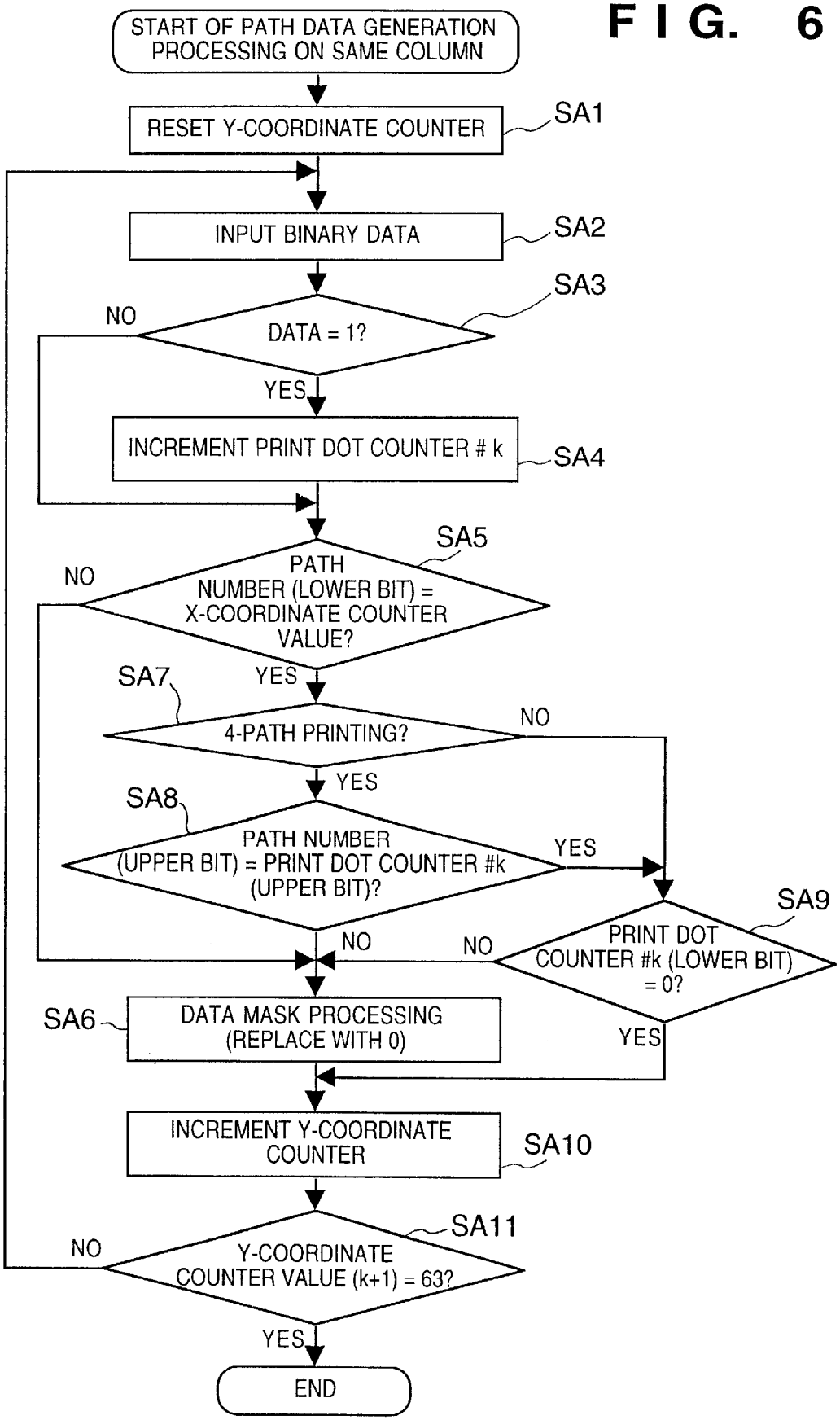
FIG. 6 is a flow chart showing detailed path data generation processing according to the first embodiment of the present invention.

FIG. 6 is a flow chart showing detailed path data generation processing according to the first embodiment of the present invention.

A Y-coordinate counter (6 bits) indicating a nozzle number to be processed is reset (step SA1). Binary data d corresponding to print dots for the number of nozzles (64) are sequentially input on the basis of the linear encoder output (step SA2). In this case, d=1 represents a print dot, and d=0 represents a non-print dot. Whether binary data is 1, i.e., a print dot is checked (step SA3). If binary data is a print dot (d=1) (YES in step SA3), a print dot counter #k corresponding to a Y-coordinate counter value (=k) is incremented (step SA4). If binary data is a non-print dot (d=0) (NO in step SA3), the flow advances to step SA4.

Fixed thinning is performed in accordance with the lower bit of the path number. In other words, whether the lower bit of the path number coincides with the X-coordinate counter value is checked (step SA5). If they do not coincide with each other (NO in step SA5), data mask processing is done (step SA6), and data thinning is done in accordance with the number of printing paths and the path number; if they coincide with each other (YES in step SA5), whether 4-path printing is set is checked (step SA7). If 4-path printing is set (YES in step SA7), whether the upper bit of the path number coincides with the upper bit of the print dot counter #k is checked (step SA8). If they do not coincide with each other (NO in step SA8), data mask processing is done (step SA6). If the upper bit of the path number coincides with the upper bit of the print dot counter #k (YES in step SA8), the flow advances to step SA9.

In step SA7, if no 4-path printing is set (NO in step SA7), i.e., 2-path printing is set, no mask processing is performed. Further, data thinning is performed in accordance with printhead numbers 0 and 1 respectively assigned to the first and second printheads 401 and 402. That is, whether the printhead number (=0) of the first printhead 401 coincides with the lower bit of the print dot counter #k is checked (step SA9). If they coincide with each other (YES in step SA9), the flow advances to step SA10; if they do not coincide with each other (NO in step SA9), data mask processing is done (step SA6).

Then, the Y-coordinate counter is incremented (step SA10). Whether the Y-coordinate counter value is 63 is checked (step SA11). If the value is not 63 (NO instep SA11), the flow returns to step SA2; if the value is 63 (YES in step SA11), data processing for the number of nozzles on the same column (X-coordinate) is completed.

By this procedure, first printhead path data of a given ink color is generated. Similarly, first printhead path data of the remaining ink colors and second printhead path data can be generated.

In this way, print dots distributed based on the number of printing paths are further distributed into two to generate first printhead path data for the first printhead 401 and second printhead path data for the second printhead 402 every printing scanning, and an image is formed with 32 nozzles for 2-pathprinting and 8 nozzles for 4-pathprinting. Accordingly, a slight individual difference in ink discharge direction or ink droplet size between nozzles can be eliminated to reduce the influence on an image, thereby forming a high-quality image. Since the duty of the print dot per scanning can be halved, the peak temperature of the printhead can be decreased to improve the reliability.

As described above, according to the first embodiment, an image is formed by efficiently distributing print dots by the fixed thinning method and data thinning method to the two printheads in which a nozzle of one printhead for discharging each color ink is laid out symmetrically to a nozzle of the other printhead for discharging this color ink. This realizes a high-quality image almost free from a blank stripe or density nonuniformity caused by a printhead twist or the like. Since the printing duty per scanning can be reduced, the peak temperature of the printhead can be decreased to realize an inkjet printing apparatus with high reliability.

Second Embodiment

According to the first embodiment, the inkjet printing apparatus having the two printheads generates print data (printhead path data) for each scanning or each printhead by the fixed thinning method of regularly distributing print dots on the basis of the coordinates of pixels and the data thinning method of distributing print dots by print dot thinning processing. However, the present invention is not limited to this, and can also be applied to only the data thinning method, only the fixed thinning method, various methods such as a random thinning method of distributing print dots using a random mask pattern, and a combination of these methods.

Hence, an inkjet printing apparatus in the second embodiment adopts only the fixed thinning method to realize a high scanning speed of the carriage.

The inkjet printing apparatus in the second embodiment has the same basic arrangement (FIGS. 1 and 4) as in the first embodiment.

As described above, the second embodiment uses the fixed thinning method as a method of distributing print dots to two printheads. An image is formed by selectively using 1-path printing and 2-path printing. In 1-path printing, print dots at coordinate positions X=2n are assigned to a first printhead 401, and print dots at coordinate positions X=2n+1 are assigned to a second printhead 402. In 2-path printing, on the first path (path number=0), print dots at coordinate positions X=4n are assigned to the first printhead 401, and print dots at coordinate positions X=4n+1 are assigned to the second printhead 402. On the second path (path number=1), print dots at coordinate positions X=4n+2 are assigned to the first printhead 401, and print dots at coordinate positions X=4n+3 are assigned to the second printhead 402. That is, path data of each printhead is generated by performing mask processing (non-print dots replace print dots) for print dots in accordance with the number of printing paths, a path number, and the lower 2 or 1 bit of the X-coordinate counter.

First printhead path data generation processing (mask processing) of each color (e.g., Cy) in the first printhead 401 for data corresponding to the number of nozzles (64) every scanning will be explained with reference to FIGS. 7 and 8.

Figure 7:
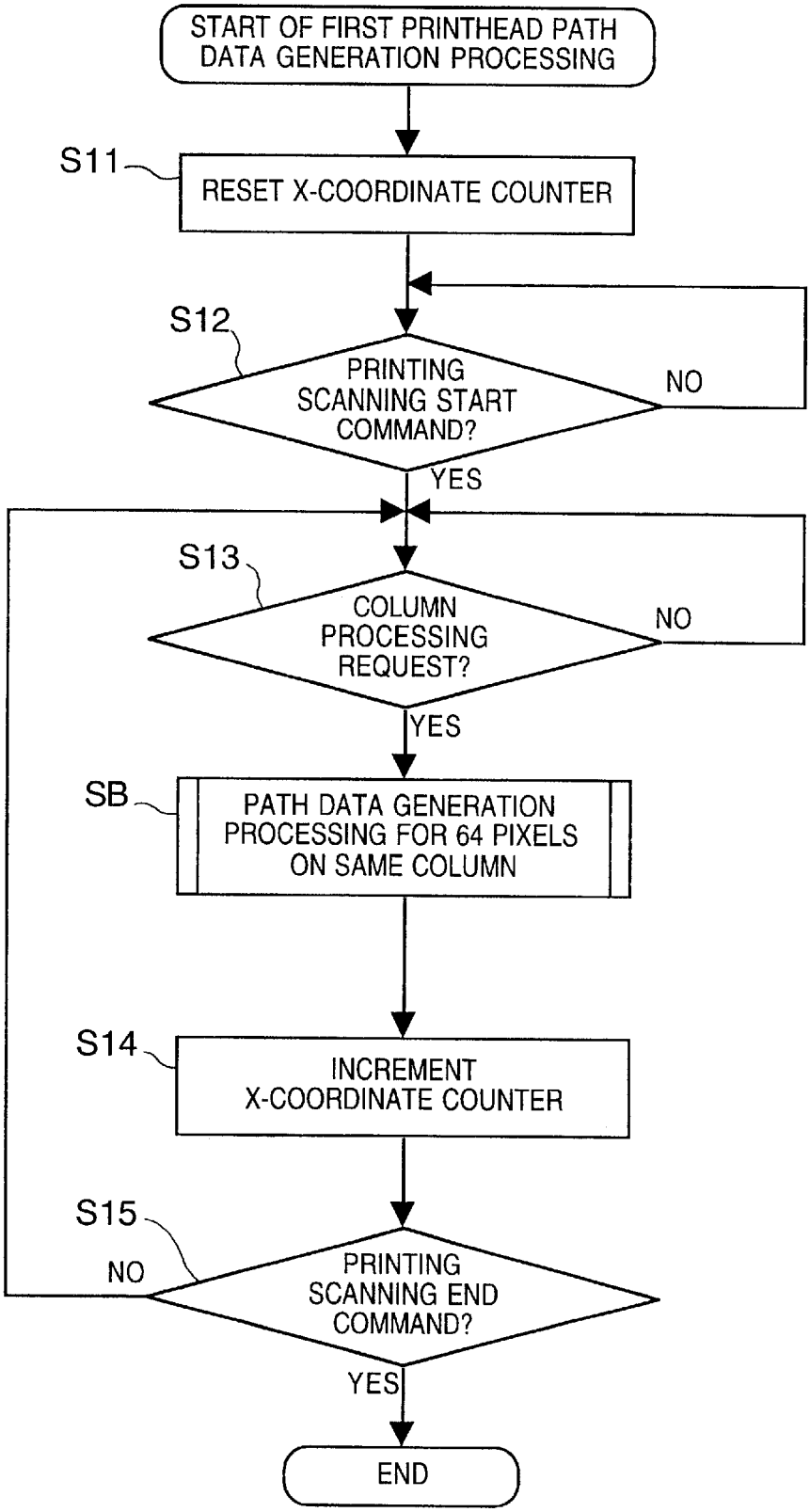
FIG. 7 is a flow chart showing first printhead path data generation processing of each color in the first printhead according to the second embodiment of the present invention.

FIG. 7 is a flow chart showing first printhead path data generation processing of each color in the first printhead according to the second embodiment of the present invention.

At the start of scanning, an X-coordinate counter (1 bit) indicating whether a column to be processed is an even- or odd-numbered one is reset (step S11). A printing start command from a controller 108 is checked (step S12). If no printing start command exists (NO in step S12), the flow waits until a printing start command is detected. If a printing start command exists (YES in step S12), a column processing request according to a linear encoder output is checked in response to the printing start command (step S13). If no column processing request exists (NO in step S13), the flow waits until a column processing request is detected. If a column processing request exists (YES in step S13), path data generation processing for 64 pixels in the Y direction is executed (step SB) The path data generation processing will be described in detail below.

Upon completion of path data generation processing, the X-coordinate counter is incremented (step S14). A printing end command is checked (step S15). If no printing end command exists (NO in step S15), the flow returns to step S13 to wait until a column processing request according to a linear encoder output is detected again. If a printing end command exists (YES in step S15), printing scanning ends in response to this.

Path data generation processing in step SB will be explained in detail with reference to FIG. 8.

Figure 8:
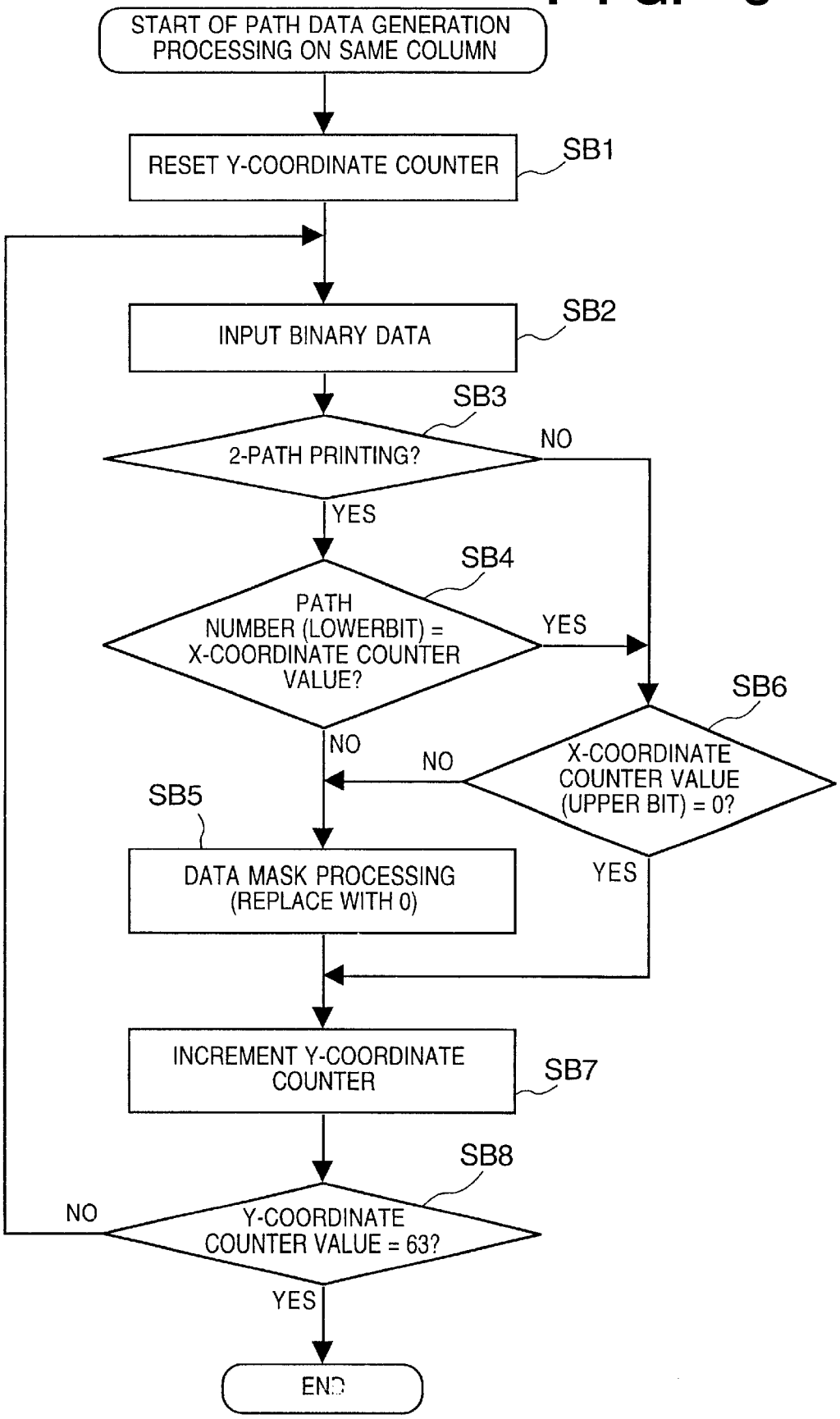
FIG. 8 is a flow chart showing detailed path data generation processing according to the second embodiment of the present invention.

FIG. 8 is a flow chart showing detailed path data generation processing according to the second embodiment of the present invention.

A Y-coordinate counter (6 bits) indicating a nozzle number to be processed is reset (step SB1). Binary data d corresponding to print dots for the number of nozzles (64) are sequentially input on the basis of the linear encoder output (step SB2). In this case, d=1 represents a print dot, and d=0 represents a non-print dot. Fixed thinning is performed in accordance with the number of printing paths and the path number. That is, whether 2-path printing is set is checked (step SB3). If 2-path printing is set (YES in step SB3), whether the lower bit of the path number coincides with the X-coordinate counter value is checked (step SB4). If they do not coincide with each other (NO in step SB4), data mask processing is done (step SB5); if they coincide with each other (YES in step SB4), the flow advances to step SB6.

In step SB4, if no 2-path printing is set (NO in step SB3), i.e., 1-path printing is set, no mask processing is performed regardless of the X-coordinate counter value and path number. Further, fixed thinning is performed in accordance with printhead numbers 0 and 1 respectively assigned to the first and second printheads 401 and 402. That is, whether the printhead number (=0) of the first printhead 401 coincides with the upper bit of the X-coordinate counter is checked (step SB6). If they coincide with each other (YES in step SB6), the flow advances to step SB7; if they do not coincide with each other (NO in step SB6), data mask processing is done (step SB5).

Then, the Y-coordinate counter is incremented (step SB7). Whether the Y-coordinate counter value is 63 is checked (step SB8). If the value is not 63 (NO in step SB8), the flow returns to step SB2; if the value is 63 (YES in step SB8), data processing for the number of nozzles on the same column (X-coordinate) is completed.

By this procedure, first printhead path data of a given ink color is generated. Similarly, first printhead path data of the remaining ink colors and second printhead path data can be generated.

The carriage speed and ink discharge frequency will be explained. The upper limit of the ink discharge frequency in the printhead is greatly limited by the refill time required to refill ink in the nozzle again after ink is discharged. Also, carriage driving is limited in speedup by various factors such as reduction of the apparatus size and cost, and guarantee of durability. In the second embodiment, the refill frequency is set to 10 kHz, the carriage speed limit is set to 20 inches/sec, and the printing resolution in the main scanning direction is set to 1,200 dpi.

As described above, in 1-path printing, one printhead prints every other dot at maximum, and thus the carriage can be driven at 16.7 inches/sec under the limitation on the refill frequency. In 2-path printing, one printhead prints every third dot at maximum at a carriage speed of 20 inches/sec under the limitation on carriage driving. In 1-path printing in the conventional inkjet printing apparatus, since one printhead must print all print dots in the X direction, the carriage speed must be set to half (8.3 inches/sec) the carriage speed in the second embodiment. Also in 2-path printing, the carriage speed is 16.7 inches/sec at maximum. In other words, the inkjet printing apparatus of the second embodiment can realize higher-speed printing processing than the conventional inkjet printing apparatus.

In this fashion, print dots distributed based on the number of printing paths are further distributed into two to generate first printhead path data for the first printhead 401 and second printhead path data for the second printhead 402 every printing scanning, and an image is formed with 64 nozzles for 1-path printing and 32 nozzles for 2-path printing. Accordingly, a slight individual difference in ink discharge direction or ink droplet size between nozzles can be eliminated to reduce the influence on an image, thereby forming a high-quality image. Since the printing resolution of one printhead per scanning can be reduced, the apparent head driving frequency limit can be increased to increase the carriage driving speed, resulting in a high printing speed.

As described above, according to the second embodiment, an image is formed by efficiently distributing print dots by the fixed thinning method to the two printheads in which a nozzle of one printhead for discharging each color ink is laid out symmetrically to a nozzle of the other printhead for discharging this color ink. This realizes a high-quality image almost free from a blank stripe or density nonuniformity caused by a print head twist or the like. Since the printing resolution of each printhead can be reduced, the carriage can be driven at a highspeed to realize an inkjet printing apparatus capable of high-speed printing processing.

Third Embodiment

In the first and second embodiments, the two printheads in which nozzles for discharging each ink are symmetrically laid out always perform reciprocal printing, and are driven by distributing print dots. However, the present invention is not limited to the case of always using this method alone. For example, the present invention can be selectively applied to a method of performing one-way printing by one printhead and a method of performing reciprocal printing by two, independent forward-path and return-path printheads, like the conventional inkjet printing apparatus.

An inkjet printing apparatus in the third embodiment, therefore, forms an image by selectively using one-way printing by one printhead and reciprocal printing by two printheads.

The inkjet printing apparatus in the third embodiment has the same basic arrangement (FIGS. 1 and 4) as in the first embodiment.

As described above, the third embodiment employs a single-head mode in which one-way printing is done using one printhead and a double-head mode in which reciprocal printing is done using two printheads, and selectively uses these modes to form an image. In general, the inkjet printing apparatus uses the double-head mode which realizes high-speed printing. If a fault such as an ink discharge error or short of ink occurs in one printhead, the double-head mode is switched to the single-head mode to avoid the stop or abort of printing operation.

The third embodiment, as well as the second embodiment, performs multipath printing using the fixed thinning method, and only 2-path printing will be explained for descriptive convenience.

In the single-head mode, even dots (X=2n) are printed on the first path, and odd dots (X=2n+1) are printed on the second path. In the double-head mode, first and second printheads 401 and 402 respectively print print dots X=4n and print dots X=4n+1 on the first path, and print dots X=4n+2 and print dots X=4n+3 on the second path.

A data processing block in the third embodiment will be described with reference to FIG. 9. The data processing block is located on the input stage (upstream) of the printhead driving block shown in FIG. 1, and relates to color correction processing and binarization processing. Color correction in the two printing modes will be mainly explained by exemplifying the case in which 8-bit Cy, Mg, and Ye color data are input, and the data processing block performs color correction processing and binarization processing to output 1-bit Cy, Mg, Ye, and Bk color data.

Figure 9:
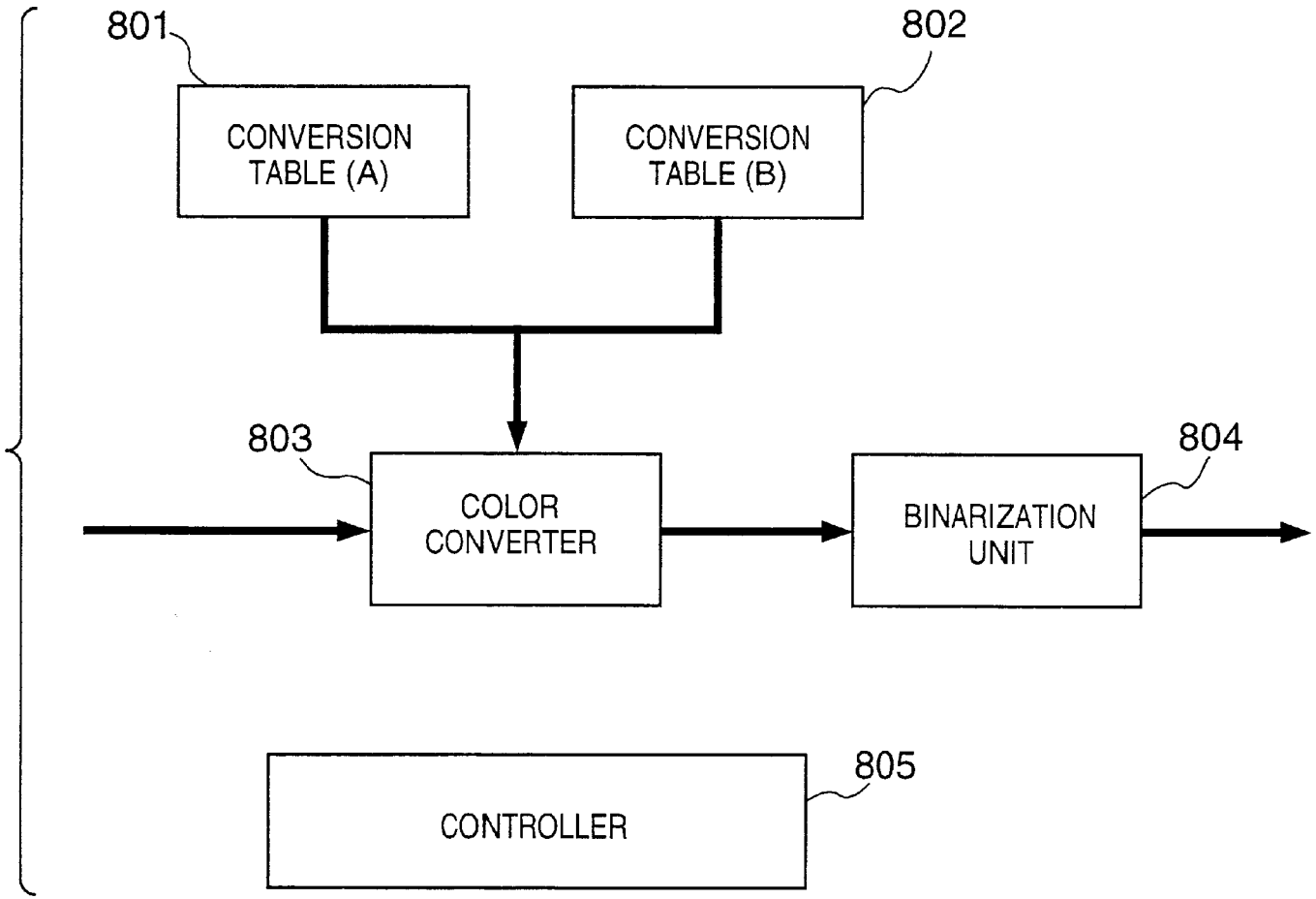
FIG. 9 is a block diagram showing the arrangement of a data processing block according to the third embodiment of the present invention.

FIG. 9 is a block diagram showing the arrangement of the data processing block according to the third embodiment of the present invention.

Reference numeral 801 denotes a conversion table (A) as a color conversion table used for color conversion in the single-head mode; 802, a conversion table (B) as a color conversion table used for color conversion in the double-head mode; 803, a color converter for performing color conversion processing for input 8-bit Cy, Mg, Ye, and Bk color data using the conversion table of a corresponding printing mode, and outputting 8-bit Cy, Mg, Ye, and Bk color data; 804, a binarization unit for generating binary data by pseudo halftone processing to output 1-bit Cy, Mg, Ye, and Bk color data; and 805, a controller for monitoring the state of each unit and performing various control operations about data processing. The controller 805 has a detection function of detecting the presence/absence of an apparatus fault and selects a printing mode and conversion table in accordance with the presence/absence of a fault.

In the single-head mode, forward-path printing is done using only the first printhead 401 or return-path printing is done using only the second printhead 402. In the single-head mode, therefore, inks are landed in the order of Bk, Cy, Mg, and Ye for all dots. In the double-head mode, since an image is formed using the two printheads, inks are landed on a sheet surface in the order of Bk, Cy, Mg, and Ye for the first half of print dots and in the order of Ye, Mg, Cy, and Bk for the second half.

As described above, when another dot overlaps a previously printed dot in the inkjet printing method, the subsequent dot tends to sink in a sheet surface deeper than the previous dot at the overlapping portion. The previous ink color becomes a preferential color, and a mixed color tinted with this preferential color is recognized. In the single-head mode, Cy is first landed on a sheet surface for all dots. To the contrary, in the double-head mode, Cy is first printed for the first half of dots, and Ye is first printed for the second half. As a result, even color mixing of the same Cy and Ye inks expresses Gr (mixed color of Cy and Mg) having different tints between the two printing modes. To prevent this, the third embodiment comprises the two conversion tables, i.e., the conversion table (A) 801 corresponding to the single-head mode and the conversion table (B) 802 corresponding to the double-head mode in order to correct the difference in ink landing order between the two printing modes, in addition to color correction suitable for the ink color. These conversion tables are selectively used in correspondence with the printing mode to avoid the difference between tints expressed by the two printing modes.

As described above, according to the third embodiment, an image is formed by efficiently distributing print dots by the fixed thinning method to the two printheads in which a nozzle of one printhead for discharging each color ink is laid out symmetrically to a nozzle of the other printhead for discharging this color ink. This realizes a high-quality image almost free from a blank stripe or density nonuniformity caused by a printhead twist or the like. When a fault occurs in one printhead, the color correction processing parameter can be changed to switch to one-way printing operation by the other printhead, thereby realizing an inkjet printing apparatus with high reliability.

Fourth Embodiment

According to the first embodiment, the inkjet printing apparatus having the two printheads generates print data (printhead path data) for each scanning or each printhead by the fixed thinning method of regularly distributing print dots on the basis of the coordinates of pixels and the data thinning method of distributing print dots by print dot thinning processing. However, the present invention is not limited to this, and can also be applied to only the data thinning method, only the fixed thinning method, a random thinning method of distributing print dots using a random mask pattern, and a combination of these methods.

An inkjet printing apparatus in the fourth embodiment adopts the random thinning method of distributing print data with reference to a random mask pattern generated based on random data or the like.

The first embodiment concerns the inkjet printing apparatus having the first printhead 401 constituted by a multi-printhead obtained by integrating four printheads corresponding to four, Bk, Cy, Mg, and Ye color inks, and the second printhead 402 having an ink layout symmetrical to that of the first printhead 401. The fourth embodiment uses a printhead constituted by a multi-printhead obtained by integrating six printheads corresponding to six, Bk, Cy, L-Cy, Mg, L-Mg, and Ye color inks. In the fourth embodiment, L-Cy and L-Mg are light cyan and light magenta having lower densities than Cy and Mg, respectively.

The inkjet printing apparatus in the fourth embodiment has the same basic arrangement (FIGS. 1 and 4) as in the first embodiment.

Figure 10:
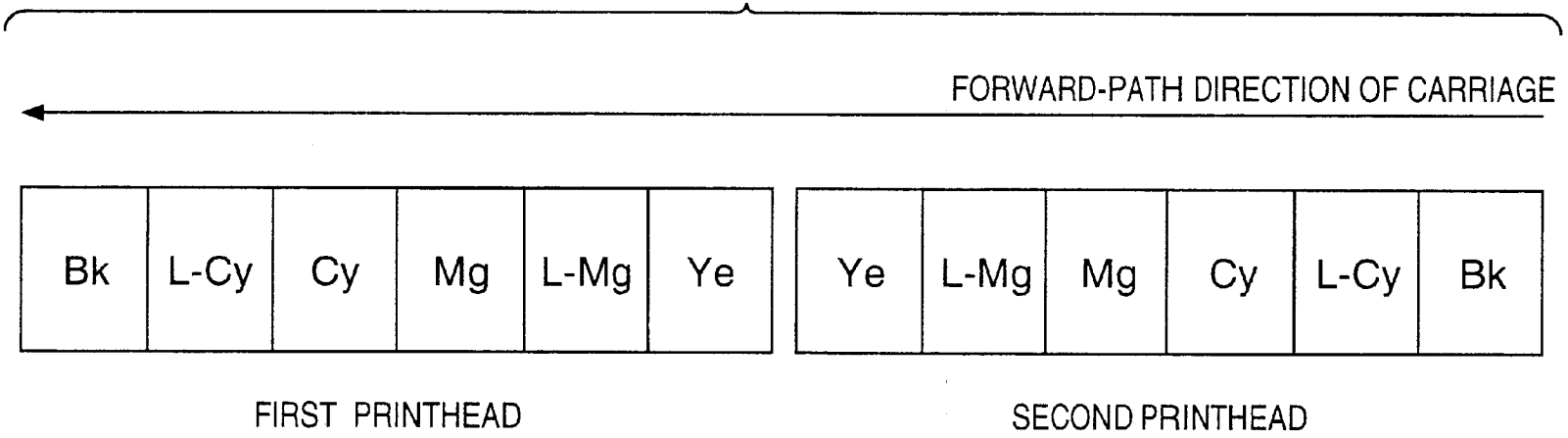
FIG. 10 is a view showing the layout of the nozzles of first and second printheads according to the second embodiment of the present invention.

As described above, in the fourth embodiment, each of two printheads is constituted by a multi-printhead obtained by integrating six printheads corresponding to the six color inks. A first printhead 401 is disposed on the front side in the forward-path scanning direction, and nozzles for discharging inks of the respective colors are laid out in the order of Bk, L-Cy, Cy, Mg, L-Mg, and Ye. A second printhead 402 is disposed on the rear side, and nozzles for discharging inks of the respective colors are laid out in the order of Ye, L-Mg, Mg, Cy, L-Cy, and Bk symmetrically to the first printhead. This layout is shown in FIG. 10.

A printhead control block for controlling printing operation of the first and second printheads 401 and 402 will be explained.

This printhead control block is the same as that of the first embodiment shown in FIG. 3.

The inkjet printing apparatus in the fourth embodiment adopts a multipath printing method of forming an image by scanning the same area a plurality of number of times in addition to performing reciprocal printing by distributing print dots to the first and second printheads 401 and 402. As described above, the multipath printing is a printing method of forming a 1-line image using a plurality of nozzles to suppress density nonuniformity caused by a slight difference in ink discharge amount or discharge direction between nozzles, and at the same time reducing the printing duty per path to prevent degradation of the image quality caused by ink blur or the like. The fourth embodiment employs the random thinning method of distributing print data with reference to a random mask pattern generated based on random data or the like.

The detailed arrangement of a multipath/double-head data generator for generating path data by the random thinning method will be described with reference to FIG. 11. The fourth embodiment will exemplify 4-path printing using the first and second printheads 401 and 402.

Figure 11:
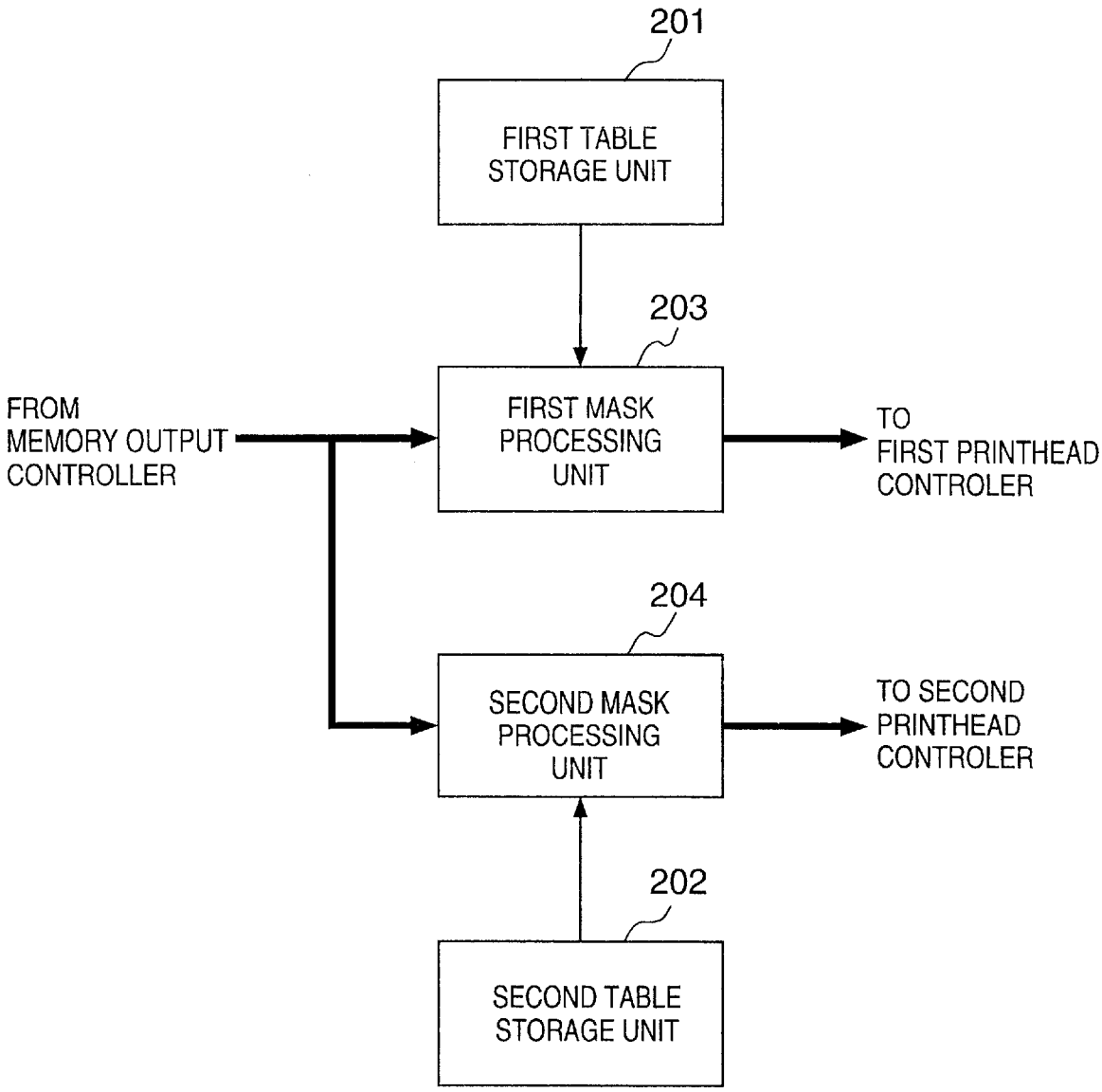
FIG. 11 is a block diagram showing the detailed arrangement of a multipath/double-head data generator according to the fourth embodiment of the present invention.

FIG. 11 is a block diagram showing the detailed arrangement of the multipath/double-head data generator according to the fourth embodiment of the present invention.

Reference numeral 201 denotes a first table storage unit which stores a mask table for the first printhead 401; 202, a second table storage unit which stores a mask table for the second printhead 402; 203, a first mask processing unit for performing mask processing of input data using the mask table stored in the first table storage unit 201; and 204, a second mask processing unit for performing mask processing of input data using the mask table stored in the second table storage unit 202. First printhead path data as an output from the first mask processing unit 203 is transferred to a first printhead controller 104, whereas second printhead path data as an output from the second mask processing unit 204 is transferred to a second printhead controller 105.

An example of the mask table will be explained with reference to FIG. 12.

Figure 12:
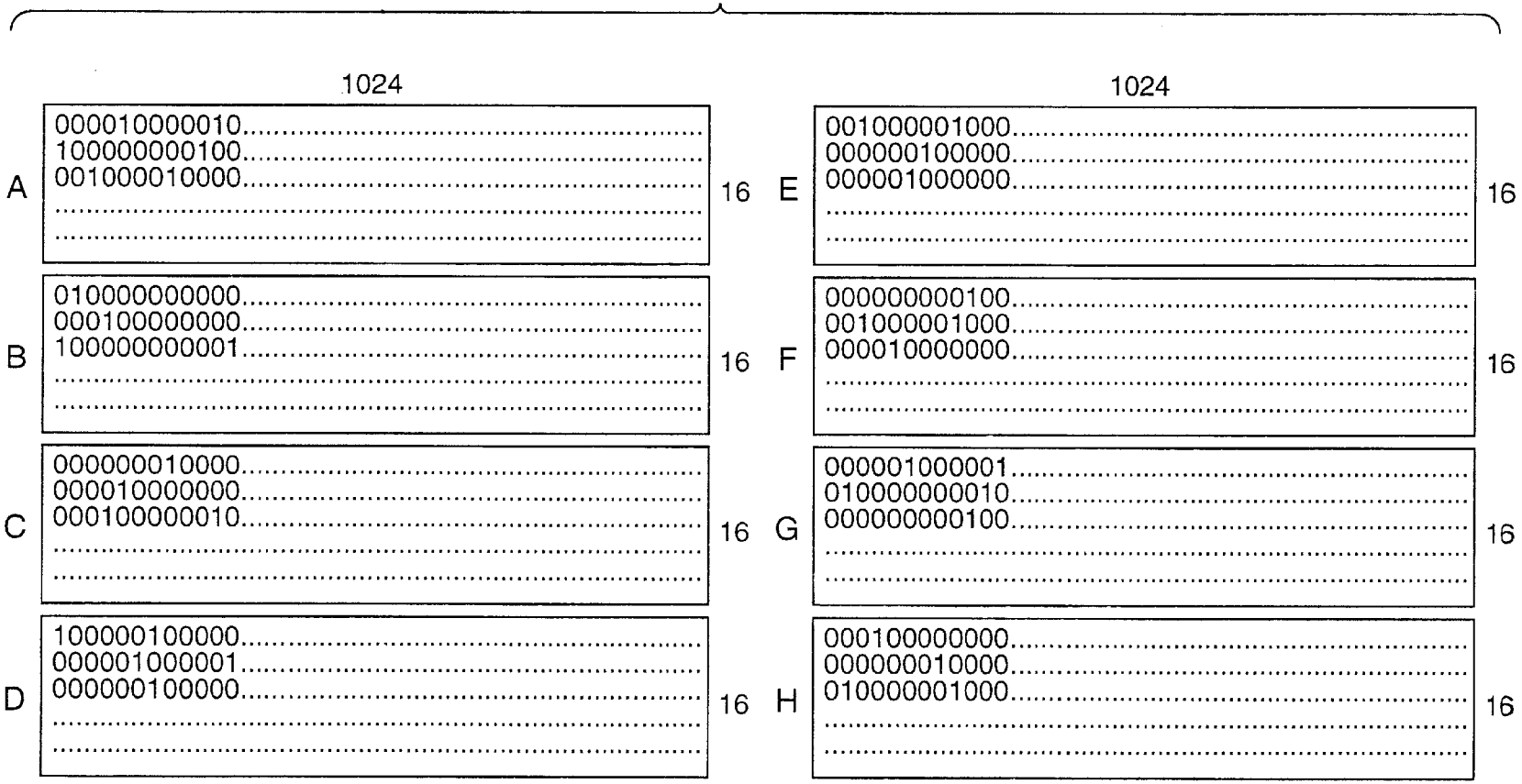
FIG. 12 is a view showing an example of a mask table according to the fourth embodiment of the present invention.

FIG. 12 is a view showing an example of the mask table according to the fourth embodiment of the present invention.

A, B, C, D, E, F, G, and H are complementary mask tables respectively used in the first, second, third, and fourth paths of the first printhead 401 and the first, second, third, and fourth paths of the second printhead 402. Each of the mask tables A to H is a table having a size corresponding to 1,024 pixels in the main scanning direction*16 pixels in the subscanning direction, and this table is repetitively mapped in respective directions and used as mask data. The number of nozzles of each of the first and second printheads 401 and 402 is 64, and the number of pixels corresponding to a paper convey amount in 4-path printing is 64/4=16, which coincides with the size of the mask table in the subscanning direction.

Printing scanning using the mask table in the fourth embodiment will be explained with reference to FIG. 13.

Figure 13:
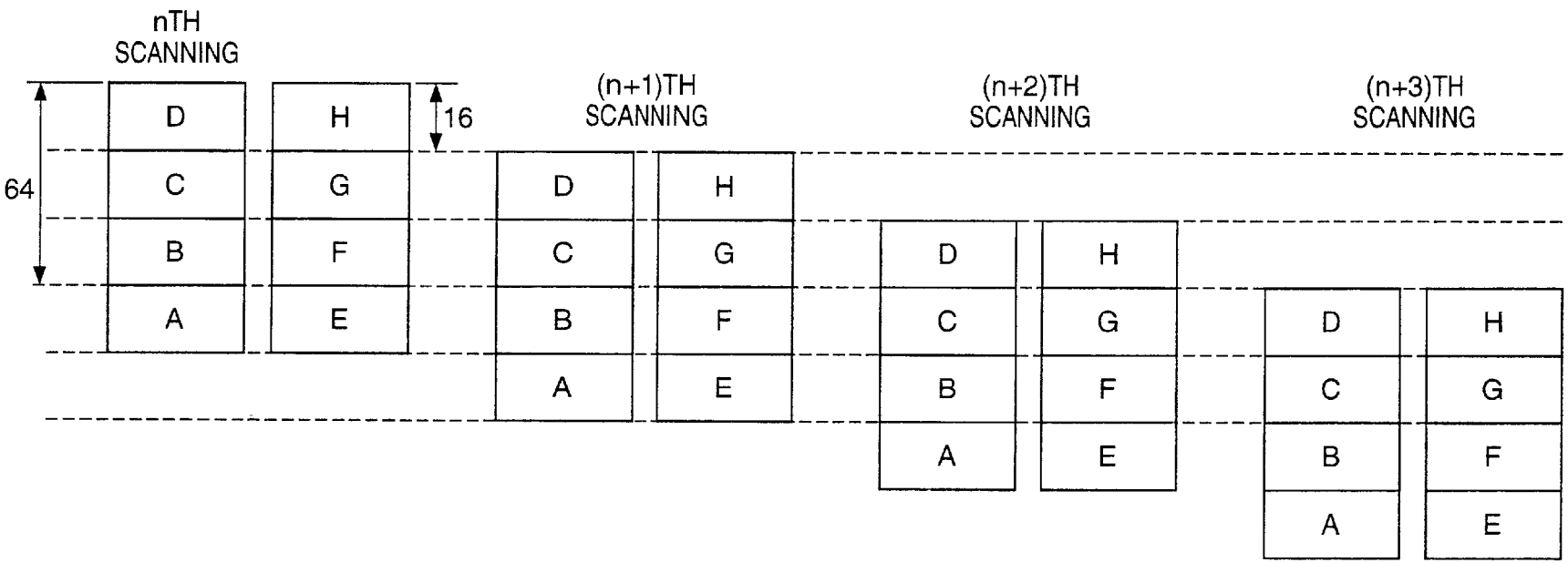
FIG. 13 is a view for explaining printing scanning using the mask table shown in FIG. 12 according to the fourth embodiment of the present invention.

FIG. 13 is a view for explaining printing scanning using the mask table shown in FIG. 12 according to the fourth embodiment of the present invention.

The first printhead 401 applies the mask tables A, B, C, and D as mask patterns in units of 16 lines to 64-line data corresponding to the 64 nozzles. Similarly, the second printhead 402 applies the mask tables E, F, G, and H as mask patterns in units of 16 lines. The entire image area undergoes mask processing in the order of A, E, B, F, C, G, D and H or E, A, F, B, G, C, H, and D to generate print data.

Generation of the mask table will be exemplified briefly.

A basic mask table generation method will be explained.

An external controller 108 for a multipath/double-head data generator 103 generates mask tables A, B, C, D, E, F. G, and H on the basis of an original mask table, and outputs them to the first and second table storage units 201 and 202. The original mask table includes respective 8-bit data basically made up of a random sequence, and has a size corresponding to 1,024 pixels in the main scanning direction*64 pixels in the subscanning direction.

In 4-path printing, the controller 108 divides respective 8-bit data by 8 to generate remainders 0, 1, 2, 3, 4, 5, 6, and 7. The controller 108 generates eight tables A, B, C, D, E, F, G, and H by generating 1 corresponding to the remainders 0, 1, 2, 3, 4, 5, 6, and 7, and stores A, B, C, and D in the first table storage unit 201 and E, F, G, and H in the second table storage unit 202. Each mask table has a size of 16 pixels in the subscanning direction.

In 2-path printing, the controller 108 generates four mask tables A, B, E, and F using remainders 0, 1, 2, and 3 resulting from division of respective 8-bit data by 4. In this case, each mask table has a size of 32 pixels in the subscanning direction.

The generated mask tables are stored in the first and second table storage units 201 and 202. The first mask processing unit 203 performs mask processing for input data using a mask table output from the first table storage unit 201. The second mask processing unit 204 performs mask processing for input data using a mask table output from the second table storage unit 202. More specifically, the mask processing unit directly outputs input data for mask table data of 1, and outputs 0 regardless of input data for mask table data of 0 (replaces input data with 0).

First printhead path data generation processing (mask processing) of each color (e.g., Cy) in the first printhead 401 for data corresponding to the number of nozzles (64) on each path will be explained with reference to FIGS. 14 and 15.

Figure 14:
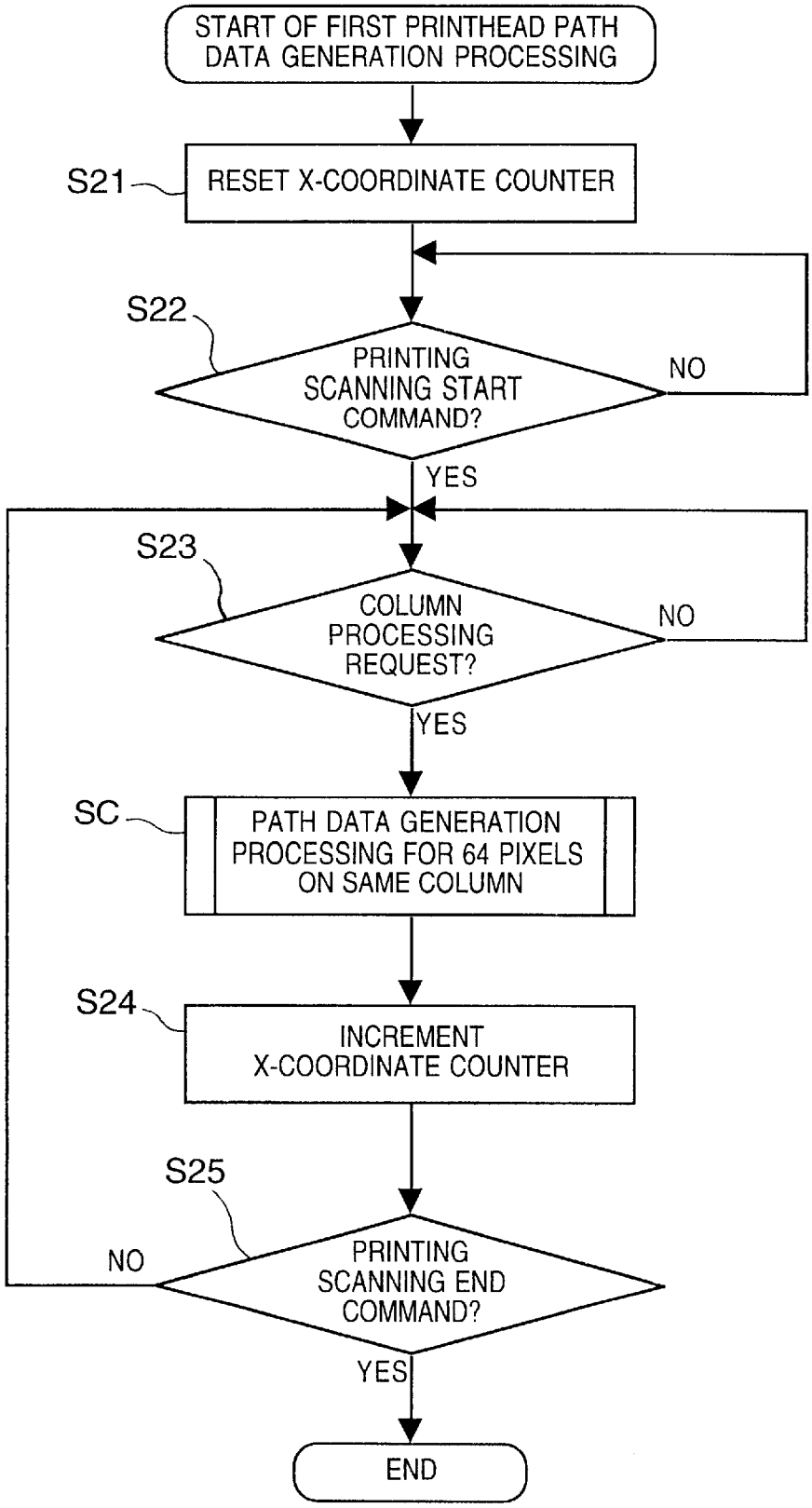
FIG. 14 is a flow chart showing first printhead path data generation processing of each color in the first printhead according to the fourth embodiment of the present invention.

FIG. 14 is a flow chart showing first printhead path data generation processing of each color in the first printhead according to the fourth embodiment of the present invention.

At the start of scanning, an X-coordinate counter (1 bit) indicating a column to be processed is reset (step S21). A printing start command from the controller 108 is checked (step S22). If no printing start command exists (NO in step S22), the flow waits until a printing start command is detected. If a printing start command exists (YES in step S22), a column processing request according to a linear encoder output is checked in response to the printing start command (step S23). If no column processing request exists (NO in step S23), the flow waits until a column processing request is detected. If a column processing request exists (YES in step S23), path data generation processing for 64 pixels in the Y direction is executed (step SC). The path data generation processing will be described in detail below.

Upon completion of path data generation processing, the X-coordinate counter is incremented (step S24). A printing end command is checked (step S25). If no printing end command exists (NO in step S25), the flow waits until a column processing request according to a linear encoder output is detected again. If a printing end command exists (YES instep S25), printing scanning ends in response to this.

Path data generation processing in step SC will be explained in detail with reference to FIG. 15.

Figure 15:
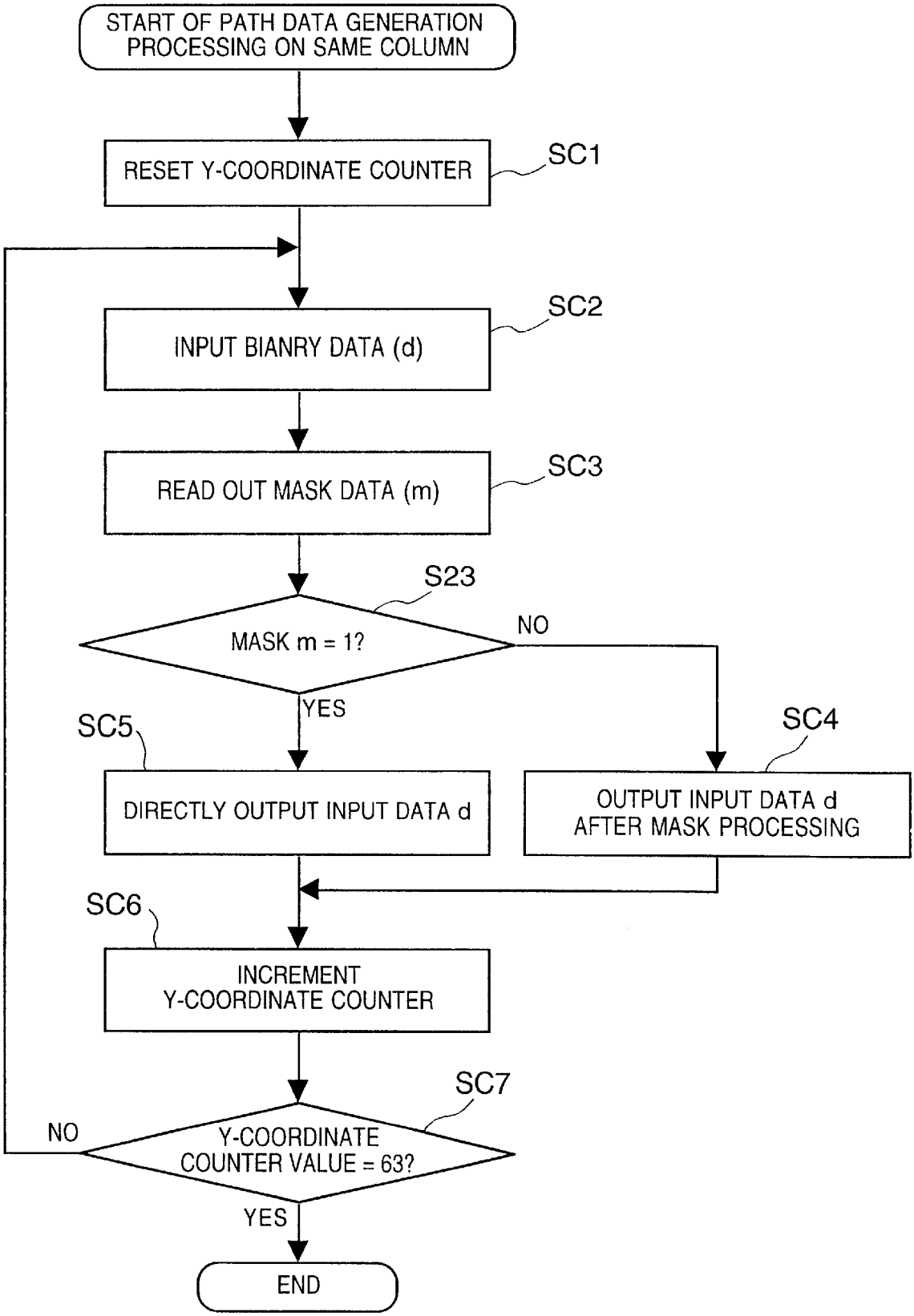
FIG. 15 is a flow chart showing detailed path data generation processing according to the fourth embodiment of the present invention.

FIG. 15 is a flow chart showing detailed path data generation processing according to the fourth embodiment of the present invention.

A Y-coordinate counter (6 bits) indicating a nozzle number to be processed is reset (step SC1). Binary data d corresponding to print dots for the number of nozzles (64) are sequentially input on the basis of the linear encoder output (step SC2). In this case, d=1 represents a print dot, and d=0 represents a non-print dot.

Data (mask data m) of a mask table at a table address determined in accordance with the X- and Y-coordinate counter values are read out (step SC3). Whether the readout mask data m is 1 is checked (step SC4). If the mask data m=0 (mask ON) (NO in step SC4), the input data d undergoes mask processing (forcibly replaced with 0) (step SC6). If the mask data m=1 (mask OFF) (YES in step SC4), the input data d does not undergo any mask processing and is directly output as output data (step SC5).

Then, the Y-coordinate counter is incremented (step SC7). Whether the Y-coordinate counter value is 63 is checked (step SC8). If the value is not 63 (NO in step SC8), the flow returns to step SC2; if the value is 63 (YES in step SC8), data processing for the number of nozzles on the same column (X-coordinate) is completed.

By this procedure, first printhead path data of a given ink color is generated. Similarly, first printhead path data of the remaining ink colors and second printhead path data can be generated.

In this manner, an image is formed by generating first printhead path data and second printhead path data every printing scanning using two complementary mask tables corresponding to the two, first and second printheads 401 and 402. Thus, a slight individual difference in ink discharge direction or ink droplet size between nozzles can be eliminated to reduce the influence on an image, thereby forming a high-quality image. Since the printing duty per scanning can be reduced, the peak temperature of the printhead can be decreased to realize an inkjet printing apparatus with high reliability.

As described above, according to the fourth embodiment, an image is formed by efficiently distributing print dots by the random thinning method to the two printheads in which a nozzle of one printhead for discharging each color ink is laid out symmetrically to a nozzle of the other printhead for discharging this color ink. This realizes a high-quality image almost free from a blank stripe or density nonuniformity caused by a printhead twist or the like. Since the printing duty per scanning can be reduced, the peak temperature of the printhead can be decreased to realize an inkjet printing apparatus with high reliability.

Fifth Embodiment

According to the fourth embodiment, the inkjet printing apparatus having the two printheads generates print data (printhead path data) for each scanning or each printhead using the random thinning method of distributing print data by looking up two mask tables generated based on random data. The two mask tables for the two printheads in the fourth embodiment are complementary to each other, and allow forming all print dots corresponding to input data at once by printing scanning of the first and second printheads 401 and 402. However, the contents of the two mask tables are not limited to this.

For example, the contents of the two mask table can be set to "mask OFF" for a predetermined coordinate position to enable overlapped landing (double landing), which realizes a higher printing duty. This is effective when a satisfactory density cannot be attained by only a single print dot.

Moreover, the two printheads can use uncomplementary mask tables. For example, the two printheads can form images at random with a predetermined printing duty. This leads to a coordinate position having no print dot and a coordinate position having two print dots in addition to a coordinate position having a single print dot. Using this mask table is effective for avoiding a periodic stripe through a formed image is slightly rough.

The contents of the mask table can be changed without any additional special hardware, so that the apparatus cost can be suppressed. The mask data is preferably optimized for a system in accordance with the ink landing precision influenced by the paper feed mechanism, ink discharge error, or the like, the ink absorptivity of a printing medium in use, or the type and intended use of image data.

In the above embodiment, the printing resolution in the subscanning direction is equal to the nozzle resolution. However, the present invention can also be applied to a combination with so-called interlaced printing of forming an image with a printing resolution as an integer multiple of the nozzle resolution.

The first, second, and third embodiments relate to the inkjet printing apparatus having a printhead constituted by a multi-printhead obtained by integrating four printheads corresponding four color inks. The fourth and fifth embodiments relate to the inkjet printing apparatus having a printhead constituted by a multi-printhead obtained by integrating six printheads corresponding to six color inks. The present invention can also be applied to an inkjet printing apparatus having a multi-printhead constituted by an independent one-color head corresponding to each ink. The number of ink colors is not limited to four or six, a plurality of inks having different densities may be used, or the same ink may be overlapped.

Figure 16:
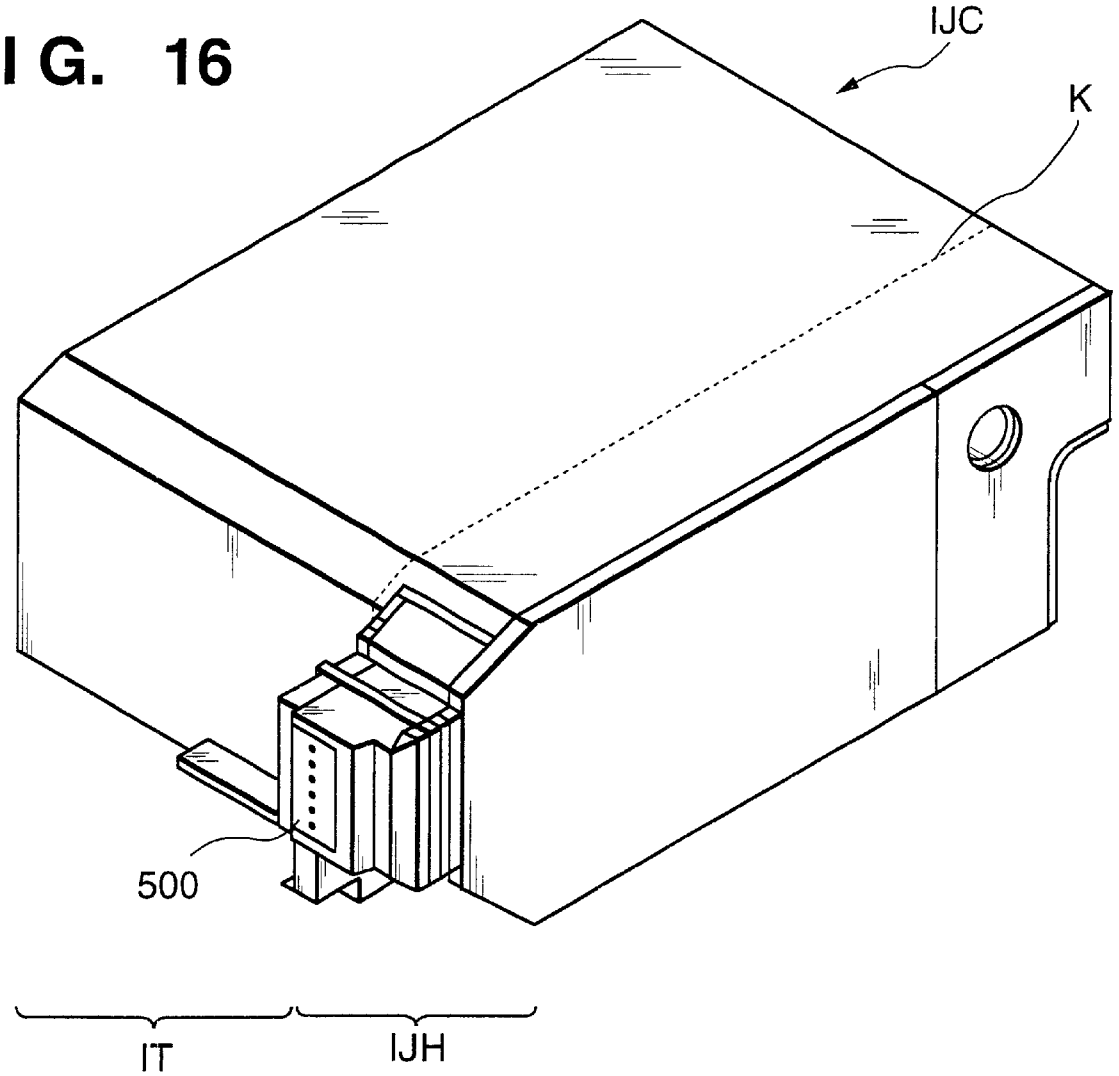
FIG. 16 is a perspective view showing the outer appearance of an ink cartridge IJC which can be disassembled into an ink tank and printhead.
Figure 17:
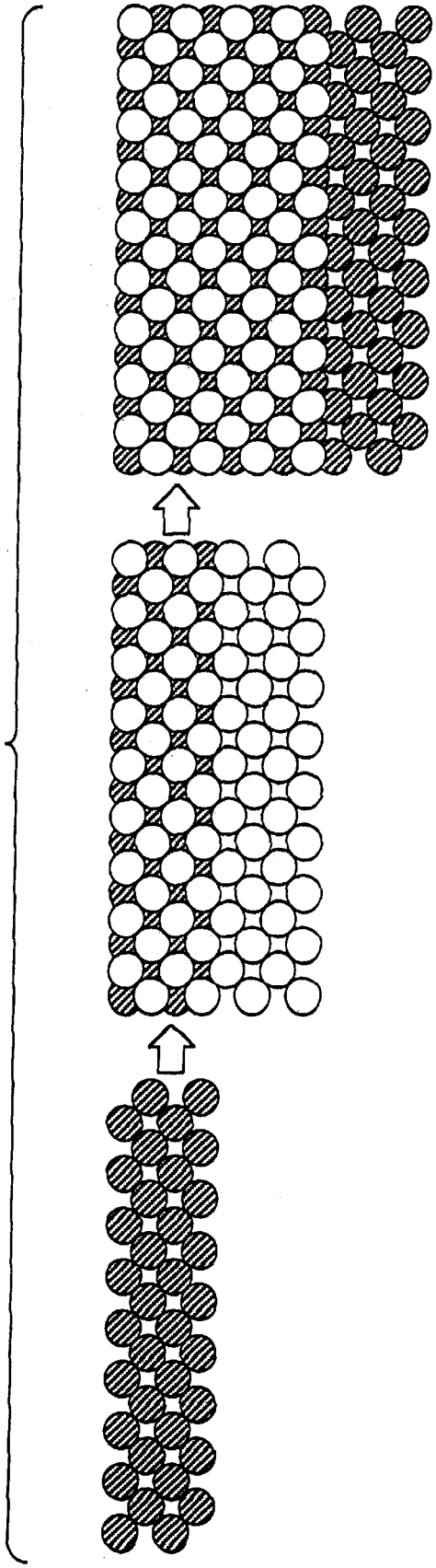
FIG. 17 PRIOR ART
FIG. 17 is a view for explaining a conventional multipath printing method.
Figure 18:
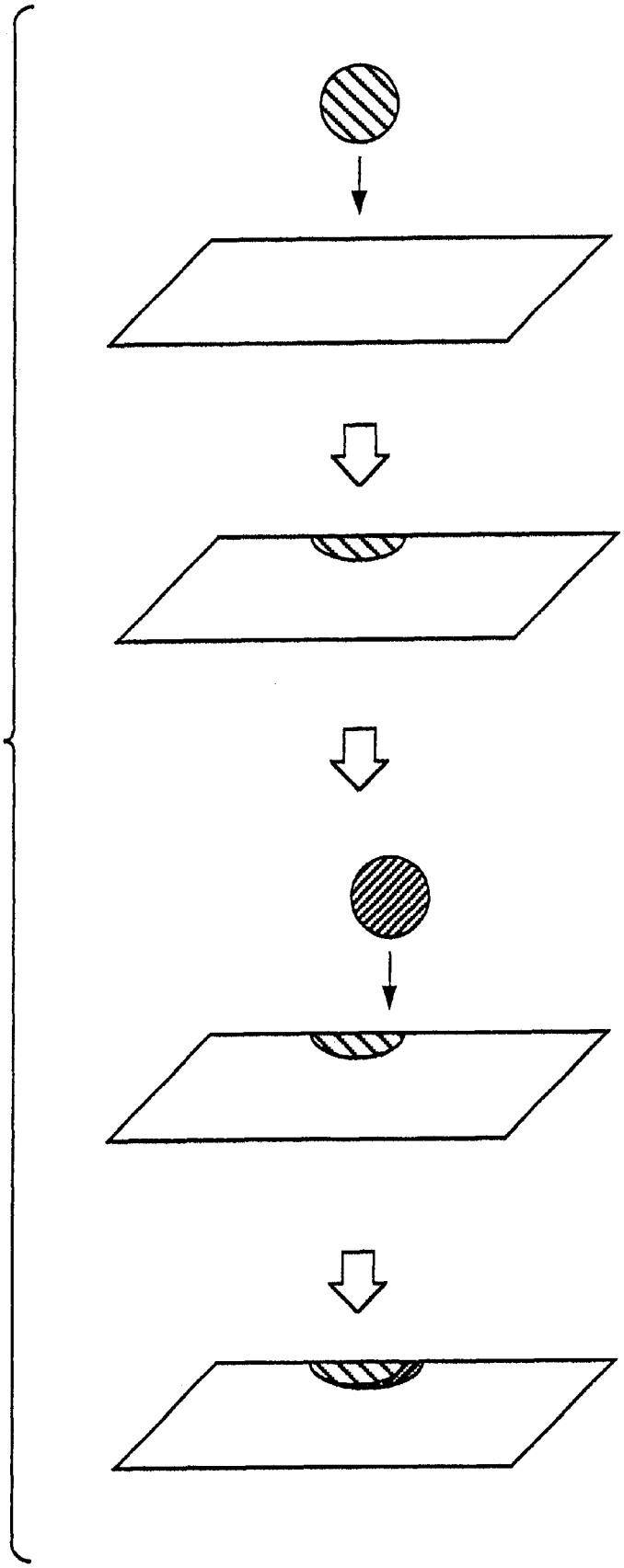
FIG. 18 PRIOR ART
FIG. 18 is a view for explaining a conventional dot landing surface of two colors.

The printhead and ink tank are exchangeably integrated. Alternatively, they may be separably assembled to make it possible to exchange only the ink tank when ink is used up. FIG. 16 shows this example.

FIG. 16 is a perspective view showing the outer appearance of an ink cartridge IJC which can be disassembled into an ink tank and printhead.

As shown in FIG. 16, the ink cartridge IJC can be disassembled into an ink tank IT and printhead IJH at a boundary line K. The ink cartridge IJC has an electrode (not shown) for receiving an electrical signal from the carriage 403 when the ink cartridge IJC is mounted on the carriage 403. The ink cartridge IJC is driven by the electrical signal to discharge ink, as described above. In FIG. 16, reference numeral 500 denotes an ink orifice array. The ink tank IT has a fibrous or porous ink absorber in order to hold ink, and the ink absorber holds ink.

In the above description, ink is discharged from the printhead in the form of droplets, and the fluid contained in the ink tank is ink. However, the contained fluid is not limited to ink. For example, the ink tank may contain a processing solution discharged to a printing medium in order to enhance the fixation and water resistance of a printed image or improve the image quality.

Further, print data binarized for each ink is temporarily stored in the memory 101, but the present invention is not limited to this. For example, print data having undergone pseudo halftone processing, input print, or print data with a resolution converted to be different from the printing resolution may be stored.

The inkjet printing apparatus according to the present invention is not limited to one integrally or separately provided as an image output apparatus for an information processing apparatus such as a computer or wordprocessor, and may be a copying machine combined with a reader or a facsimile apparatus having a communication function.

The above embodiments comprise a means (e.g., an electrothermal converter or laser beam) for generating heat energy as energy used to discharge ink, and uses a method of changing the state of ink by the heat energy, among various ink-jet printing methods. Accordingly, a high-density, high-definition image can be printed.

As for the typical structure and principle, it is preferable to employ the basic principle disclosed in, for example, U.S. Pat. No. 4,723,129 or U.S. Pat. No. 4,740,796. The above method can be adapted to both a so-called on-demand type apparatus and a continuous type apparatus. In particular, a satisfactory effect can be obtained when the on-demand type apparatus is employed because of the structure arranged in such a manner that at least one drive signal, which rapidly raises the temperature of an electrothermal converter disposed to face a sheet or fluid passage which holds the fluid (ink) to a level higher than levels at which film boiling takes place are applied to the electrothermal converter in accordance with print information so as to generate heat energy in the electrothermal converter and to cause the heat effecting surface of the printhead to take place film boiling so that bubbles can be formed in the fluid (ink) to correspond to the one or more drive signals. The enlargement/contraction of the bubble will cause the fluid (ink) to be discharged through a discharging opening so that at least one droplet is formed. If a pulse drive signal is employed, the bubble can be enlarged/contracted immediately and properly, causing a further preferred effect to be obtained because the fluid (ink) can be discharged while revealing excellent responsibility.

It is preferable to employ a pulse drive signal disclosed in U.S. Pat. No. 4,463,359 or U.S. Pat. No. 4,345,262. If conditions disclosed in U.S. Pat. No. 4,313,124 which is an invention relating to the temperature rising ratio at the heat effecting surface are employed, a satisfactory printing result can be obtained.

As an alternative to the structure (linear fluid passage or perpendicular fluid passage) of the printhead disclosed in each of the above inventions and having an arrangement that the orifices, fluid passages, and electrothermal converters are combined, a structure having an arrangement that the heat effecting surface is disposed in a bent region and disclosed in U.S. Pat. No. 4,558,333 or U.S. Pat. No. 4,459,600 may be employed. In addition, the following structures may be employed: a structure having an arrangement that a common slit is formed to serve as an orifice of a plurality of electrothermal converters and disclosed in Japanese Patent Laid-Open No. 59-123670; and a structure disclosed in Japanese Patent Laid-Open No. 59-138461 in which an opening for absorbing pressure waves of heat energy is disposed to correspond to the orifice.

In addition, the invention is effective for a printhead of the freely exchangeable chip type which enables electrical connection to the apparatus main body or supply of ink from the apparatus main body by being mounted onto the apparatus main body, or for the case by use of a printhead of the cartridge type provided integrally on the printhead itself.

It is preferred to additionally employ a printhead restoring means and auxiliary means provided as the component of the present invention because printing operation can be further stabled. Specifically, it is preferable to employ a printhead capping means, cleaning means, pressurizing or suction means, electrothermal converter, another heating element or a sub-heating means constituted by combining them and a sub-discharge mode in which ink is discharged independently from printing operation in order to stabilize printing operation.

Further, the printing mode of the printing apparatus is not limited to a printing mode using only a major color such as black, but may include at least one of a printing mode using a plurality of different colors or a printing mode using full colors by color mixing, which can be implemented by integrating printheads or combining a plurality of printheads.

Although a fluid ink is employed in the above embodiments, an ink which is solidified at room temperature or lower, or an ink which is softened or liquefied at room temperature may be used. That is, any ink which is liquefied when a printing signal is supplied may be used because a general inkjet apparatus adjusts the temperature of the ink itself within the range of 30° C. or more to 70° C. or less to control the temperature so as to make the viscosity of the ink fall within a stable discharge range.

Furthermore, an ink which is solidified when it is caused to stand, and liquefied when heat energy is supplied can be adapted to positively prevent a temperature rise caused by heat energy by utilizing the temperature rise as energy of state transition from the solid state to the liquid state or to prevent ink evaporation. In any case, an ink which is liquefied when heat energy is supplied in accordance with a printing signal so as to be discharged in the form of fluid ink, or an ink which is liquefied only after heat energy is supplied, e.g., an ink which starts to solidify when it reaches a printing medium, can be adapted to the present invention. In the above case, the ink may be of a type which is held as fluid or solid material in a recess of a porous sheet or a through hole at a position to face the electrothermal converter as disclosed in Japanese Patent Laid-Open No. 54-56847 or No. 60-71260. It is the most preferred way for the ink to be adapted to the above film boiling method.

The present invention may be applied to a system constituted by a plurality of devices (e.g., a host computer, interface device, reader, and printer) or an apparatus comprising a single device (e.g., a copying machine or facsimile apparatus).

The object of the present invention is realized even by supplying a storage medium storing software program codes for realizing the functions of the above-described embodiments to a system or apparatus, and causing the computer (or a CPU or MPU) of the system or apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy disk, hard disk, optical disk, magneto optical disk, CD-ROM, CD-R, magnetic tape, nonvolatile memory card, ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As has been described above, the present invention can provide a printing apparatus for realizing high-speed, high-quality printing without causing any tint difference in reciprocal printing, and a control method therefor, and a computer-readable memory.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for forming an image of print dots by discharging ink to a printing medium on the basis of input image information, comprising:

a first printhead having a first array of a plurality of ink orifices arranged substantially in a printing medium conveying direction for discharging a first ink, and a second array of a plurality of ink orifices arranged substantially in the printing media conveying direction, for discharging a second ink of a type different from that of the first ink, wherein the first array and the second array are arranged in a main scanning direction different from the printing media conveying direction;

a second printhead having a third array and a fourth array which are laid out symmetrically in the main scanning direction to each of the first array and the second array of said first printhead;

a distribution unit that distributes print dot data corresponding to print dots to be printed based on the input image information to first and second print dot data; and a printing controller that controls performance of printing first print dots by said first printhead in accordance with the first print dot data and performance of printing second print dots by said second printhead in accordance with the second print dot data, wherein when said first and second printheads are used for printing the first and second print dots, both said first printhead and said second printhead perform bi-directional printing by scanning said first and second printheads bi-directionally in the main scanning direction.

2. The apparatus according to claim 1, further comprising a first printing mode of performing reciprocal printing while said first and second printheads are relatively reciprocally scanned on a printing medium.

3. The apparatus according to claim 2, wherein said distribution unit generates the first and second print dot data for each path in multipath printing control by thinning out print dots using a mask pattern.

4. The apparatus according to claim 3, wherein the mask pattern is a random mask pattern in which print dots and non-print dots are laid out at random.

5. The apparatus according to claim 3, wherein the mask pattern comprises two complementary mask patterns.

6. The apparatus according to claim 5, wherein a predetermined position of the mask pattern is set to "mask OFF".

7. The apparatus according to claim 3, wherein the mask pattern comprises two uncomplementary mask patterns.

8. The apparatus according to claim 2, wherein said distribution unit generates the first and second print dot data for each path in multipath printing control by thinning out print dots using a thinning pattern based on coordinates of the print dots.

9. The apparatus according to claim 2, wherein said distribution unit generates the first and second print dot data for each path in multipath printing control by thinning out print dots.

10. The apparatus according to claim 2, further comprising a second printing mode of forming an image while either one of said first and second printheads is scanned on a forward path or return path, and said apparatus operates by selectively using the first and second printing modes.

11. The apparatus according to claim 10, wherein said first and second printheads are reciprocally scanned at a higher speed in the first printing mode than the second printing mode.

12. The apparatus according to claim 10, further comprising:

first color correction means for performing color correction processing corresponding to the first printing mode; and second color correction means for performing color correction processing corresponding to the second printing mode.

13. The apparatus according to claim 10, further comprising:

detection means for detecting presence/absence of a fault in said first and second printheads; and selection means for selectively using the first and second printing modes on the basis of a detection result of said detection means, and when said detection means detects a fault in either one of said first and second printheads, said apparatus is switched to the second printing mode using the other printhead.

14. The apparatus according to claim 1, wherein said first and second printheads are inkjet printheads for performing printing by discharging ink.

15. The apparatus according to claim 1, wherein said first and second printheads discharge ink using heat energy and comprise heat energy converters for generating heat energy to be supplied to ink.

16. A control method for a printing apparatus for forming an image of print dots by discharging ink to a printing medium on the basis of input image information, the apparatus including a first printhead having a first array of a plurality of ink orifices arranged substantially in a printing medium conveying direction for discharging a first ink, and a second array of a plurality of ink orifices arranged substantially in the printing medium conveying direction, for discharging a second ink of a type different from that of the first ink, wherein the first array and the second array are arranged in a main scanning direction different from the printing medium conveying direction, and a second printhead having a third array and a fourth array which are laid out symmetrically in the main scanning direction to each of the first array and the second array of the first printhead, said method comprising:

a distribution step, of distributing print dot data corresponding to print dots to be printed based on the input image information to first and second print dot data; and a printing control step, of controlling performance of printing first print dots by said first printhead in accordance with the first print dot data and performance of printing second print dots by said second printhead in accordance with the second print dot data, wherein when said first and second printheads are used for printing the first and second print dots, both said first printhead and said second printhead perform bi-directional printing by scanning said first and second printheads bi-directionally in the main scanning direction.

17. The method according to claim 16, wherein said apparatus comprises a first printing mode of performing reciprocal printing while said first and second printheads are relatively reciprocally scanned on a printing medium.

18. The method according to claim 17, wherein the distribution step comprises generating the first and second print dot data for each path in multipath printing control by thinning out print dots using a mask pattern.

19. The method according to claim 18, wherein the mask pattern is a random mask pattern in which print dots and non-print dots are laid out at random.

20. The method according to claim 18, wherein the mask pattern comprises two complementary mask patterns.

21. The method according to claim 20, wherein a predetermined position of the mask pattern is set to "mask OFF".

22. The method according to claim 18, wherein the mask pattern comprises two uncomplementary mask patterns.

23. The method according to claim 17, wherein the distribution step comprises generating the first and second print dot data for each path in multipath printing control by thinning out print dots using a thinning pattern based on coordinates of the print dots.

24. The method according to claim 17, wherein the distribution step comprises generating the first and second print dot data for each path in multipath printing control by thinning out print dots.

25. The method according to claim 17, wherein said apparatus has a second printing mode of forming an image while either one of said first and second printheads is scanned on a forward path or return path, and said method selectively uses the first and second printing modes.

26. The method according to claim 25, wherein said first and second printheads are reciprocally scanned at a higher speed in the first printing mode than the second printing mode.

27. The method according to claim 25, further comprising:

a first color correction step of performing color correction processing corresponding to the first printing mode; and a second color correction step of performing color correction processing corresponding to the second printing mode.

28. The method according to claim 25, further comprising:

a detection step of detecting presence/absence of a fault in said first and second printheads; and a selection step of selectively using the first and second printing modes on the basis of a detection result in the detection step, and when a fault is detected in either one of said first and second printheads in the detection step, said method switches the mode to the second printing mode using the other printhead.

29. The method according to claim 16, wherein said first and second printheads are inkjet printheads for performing printing by discharging ink.

30. The method according to claim 16, wherein said first and second printheads discharge ink using heat energy and comprise heat energy converters for generating heat energy to be supplied to ink.

31. A computer-readable memory storing control program codes for a printing apparatus for forming an image of print dots by discharging ink to a printing medium on the basis of input image information, the apparatus including a first printhead having a first array of a plurality of ink orifices arranged substantially in a printing medium conveying direction for discharging a first ink, and a second array of a plurality of ink orifices arranged substantially in the printing medium conveying direction, for discharging a second ink of a type different from that of the first ink, wherein the first array and the second array are arranged in a main scanning direction different from the printing medium conveying direction, and a second printhead having a third array and a fourth array which are laid out symmetrically in the main scanning direction to each of the first array and the second array of the first printhead, said memory storage program comprising:

program code for a distribution step of distributing print dot data corresponding to print dots to be printed based on the input image information to first and second print dot data; and program code for a printing control step of controlling performance of printing first print dots by said first printhead in accordance with the first print dot data and performance of printing second print dots by said second printhead in accordance with the second print dot data, wherein when said first and second printheads are used for printing the first and second print dots, both said first printhead and said second printhead perform bi-directional printing by said first and second printheads bi-directionally in the main scanning direction.

* * * * *

UNITED STATES PATENT AND TRADEMARK OFFICE

CERTIFICATE OF CORRECTION

PATENT NO. : 6,315,387 B1 
DATED : November 13, 2001
INVENTOR(S) : Hiroki Horikoshi It is certified that error appears in the above-identified patent and that said Letters Patent is hereby corrected as shown below:

Title page,
Item [56], U.S. PATENT DOCUMENTS, insert:

| | | | | |
|---|---|---|---|---|
| -- 4,413,275 | 11/01/83 | Horiuchi et al. | 358 | 75 |
| 4,698,644 | 10/06/87 | Drago et al. | 347 | 40 |
| 5,124,720 | 06/23/92 | Schantz | 347 | 40 |
| 5,241,325 | 08/31/93 | Nguyen | 347 | 40 |
| 5,645,359 | 07/08/97 | Goto | 400 | 323 |
| 5,668,581 | 09/16/97 | Tsuji et al. | 347 | 40 |
| 5,923,349 | 11/01/83 | Meyer | 347 | 41 --. |

Column 1,
Line 15, “eapparatuse” should read -- apparatus --;
Line 61, “practically using” should read -- practical use of --.

Column 2,
Line 5, “Such” should read -- Such an --;
Line 30, “methodisproposed” should read -- method is proposed --; and “multipathprinting” should read -- multi-path printing --.

Column 8,
Line 29, “4-pathprinting. Maskprocessing” should read -- 4-path printing. Mask processing --.

Column 10,
Line 1, “instep” should read -- in step --.
Line 14, “2-pathprinting” should read -- 2-path printing --; and “4-pathprinting.” should read -- 4-path printing. --.

Column 18,
Line 9, “table” should read -- tables --;
Line 38, “four” should read -- to four --;
Line 38, “the” (second occurrence) should be deleted.

UNITED STATES PATENT AND TRADEMARK OFFICE

CERTIFICATE OF CORRECTION

PATENT NO. : 6,315,387 B1
DATED : November 13, 2001
INVENTOR(S) : Hiroki Horikoshi It is certified that error appears in the above-identified patent and that said Letters Patent is hereby corrected as shown below:

Column 24,
Line 55, "by" should read -- by scanning --.

Signed and Sealed this

Second Day of July, 2002

*Attest:*

*Attesting Officer*

JAMES E. ROGAN
*Director of the United States Patent and Trademark Office*